US009969192B2

(12) United States Patent
Suzuki et al.

(10) Patent No.: US 9,969,192 B2
(45) Date of Patent: May 15, 2018

(54) PRINTING APPARATUS AND SHEET WINDING METHOD

(71) Applicant: CANON KABUSHIKI KAISHA, Tokyo (JP)

(72) Inventors: Yoshiaki Suzuki, Nagareyama (JP); Ryoya Shinjo, Kawasaki (JP); Tsuyoshi Mikoshiba, Yokohama (JP); Masaki Komatsu, Kawasaki (JP); Ryo Kobayashi, Kawasaki (JP); Ryo Harigae, Koganei (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 14/939,030

(22) Filed: Nov. 12, 2015

(65) Prior Publication Data

US 2016/0136981 A1 May 19, 2016

(30) Foreign Application Priority Data

Nov. 19, 2014 (JP) ..... 2014-234757
Aug. 31, 2015 (JP) ..... 2015-171424

(51) Int. Cl.
*B41J 15/16* (2006.01)
*B65H 18/10* (2006.01)
(Continued)

(52) U.S. Cl.
CPC ..... *B41J 15/16* (2013.01); *B41J 15/04* (2013.01); *B65H 23/188* (2013.01); *B65H 16/02* (2013.01); *B65H 16/10* (2013.01); *B65H 18/085* (2013.01); *B65H 18/103* (2013.01); *B65H 20/02* (2013.01); *B65H 23/04* (2013.01);
(Continued)

(58) Field of Classification Search
None
See application file for complete search history.

(56) References Cited

U.S. PATENT DOCUMENTS 1,893,891 A * 1/1933 Halliwell ..... B65H 23/08 242/422.6
2,005,738 A * 6/1935 Foster ..... B65H 23/08 226/114
(Continued)

FOREIGN PATENT DOCUMENTS

JP 11-011750 A 1/1999
JP 2002-348011 A 12/2002
(Continued)

OTHER PUBLICATIONS

Copending, unpublished U.S. Appl. No. 14/939,115 to Ryo Kobayashi et al, dated Nov. 12, 2015.

*Primary Examiner* — Jill Culler
(74) *Attorney, Agent, or Firm* — Fitzpatrick, Cella, Harper & Scinto

(57) ABSTRACT

A printing apparatus includes: a printing unit configured to perform printing on a sheet; a driving unit configured to apply a rotational force to a roll member that is rotatably held; and a pressing unit having a roller configured to apply a pressing force to an outer peripheral surface of a roll sheet wound around the roll member, wherein the pressing unit changes the pressing force during a sequence in which the driving unit applies a rotational force to the roll member and a sheet that has passed through the printing unit is wound.

20 Claims, 24 Drawing Sheets

(51) Int. Cl.

| | |
|---|---|
| ***B41J 15/04*** | (2006.01) |
| ***B65H 23/188*** | (2006.01) |
| *B65H 20/02* | (2006.01) |
| *B65H 18/08* | (2006.01) |
| *B65H 16/10* | (2006.01) |
| *B65H 16/02* | (2006.01) |
| *B65H 23/195* | (2006.01) |
| *B65H 23/04* | (2006.01) |

(52) U.S. Cl.
CPC .. *B65H 23/1955* (2013.01); *B65H 2301/5121* (2013.01); *B65H 2301/5151* (2013.01); *B65H 2403/942* (2013.01); *B65H 2701/1311* (2013.01); *B65H 2801/36* (2013.01)

(56) References Cited

U.S. PATENT DOCUMENTS 2,053,022 A * 9/1936 Corswandt ..... B65H 23/08 242/566
2,686,013 A * 8/1954 Christian ..... B65H 18/103 242/538.1
3,670,980 A * 6/1972 Mukai ..... B65H 18/10 242/547
4,150,797 A * 4/1979 Kataoka ..... B65H 18/10 242/541.6
4,343,440 A * 8/1982 Engl ..... B65H 18/26 242/547
4,742,968 A * 5/1988 Young, Jr. ..... B65H 18/26 242/541.1
4,998,121 A 3/1991 Koh et al.
5,035,373 A * 7/1991 Perrigo ..... B65H 18/26 242/413.3
5,043,763 A 8/1991 Koh et al.
5,308,008 A * 5/1994 Ruegg ..... B65H 18/26 242/541.7
5,850,982 A * 12/1998 Roth ..... B65H 18/08 226/190
5,868,893 A * 2/1999 Kipper ..... B65C 11/004 156/277
7,832,677 B2 * 11/2010 Lannes ..... B65H 18/22 242/413
8,152,167 B2 4/2012 Saito et al.
8,672,439 B2 3/2014 Suzuki et al.
8,783,859 B2 7/2014 Tokisawa et al.
2012/0263514 A1 10/2012 Tanami et al.
2013/0277482 A1 * 10/2013 Naramatsu ..... B65H 23/063 242/334
2014/0239113 A1 8/2014 Igarashi et al.
2015/0251865 A1 9/2015 Nishida et al.
2015/0256694 A1 9/2015 Suzuki et al.
2015/0328906 A1 11/2015 Sumioka et al.
2015/0353307 A1 12/2015 Nishida et al.
2015/0353308 A1 12/2015 Taguchi et al.

FOREIGN PATENT DOCUMENTS

JP 2003-012205 A 1/2003
JP 2013-116561 A 6/2013

* cited by examiner

PRINTING APPARATUS AND SHEET WINDING METHOD

BACKGROUND OF THE INVENTION

Field of the Invention

The present invention relates to a printing apparatus having a sheet winding function of winding a sheet print medium (hereinafter also referred to simply as a sheet) in the form of a roll sheet.

Description of the Related Art

Conventionally, there is known a printing apparatus that can wind up a printed sheet into the form of a roll sheet while continuing a printing operation. Japanese Patent Laid-Open No. 2013-116561 discloses a printing apparatus having a plurality of roll sheet holding units, each of which can be used for both supplying a sheet to a printing unit and winding a sheet from the printing unit.

SUMMARY OF THE INVENTION

With the configuration of Japanese Patent Laid-Open No. 2013-116561, however, in the case of using the holding unit for winding, fixing a leading end of a sheet to a roll member for sheet winding requires a user to hold a sheet by hand to apply a tension to the sheet. This may place a burden on the user. Furthermore, at the conclusion of winding up the sheet, the user may also need to hold a rear (i.e., trailing) end of the sheet by hand to avoid loosening of the winding.

The present invention has been made to solve the above problems, and an object of the present invention is to provide a printing apparatus having a sheet winding function in which a burden on a user during sheet winding is reduced, and a sheet winding method.

A printing apparatus of the present invention for solving the above problems includes: a printing unit configured to perform printing on a sheet; a driving unit configured to apply a rotational force to a roll member that is rotatably held; and a pressing unit having a roller configured to apply a pressing force to an outer peripheral surface of a roll sheet wound around the roll member, wherein the pressing unit changes the pressing force during a sequence in which the driving unit applies a rotational force to the roll member and a sheet that has passed through the printing unit is wound.

According to the above configuration, in fixing the leading end of the sheet to the roll member for sheet winding, the pressing unit can apply a pressing force to the sheet, and can apply a tension to the sheet without involving the user's hand. In winding up the sheet to the trailing end, the pressing unit can apply a pressing force to the sheet, so as to avoid loosening of the winding. Accordingly, a printing apparatus having the sheet winding function is achieved in which a burden on the user is reduced.

Further features of the present invention will become apparent from the following description of exemplary embodiments (with reference to the attached drawings).

DESCRIPTION OF THE EMBODIMENTS

The present invention can be applied to different types of image forming apparatuses, such as a printing apparatus, a copier, and a facsimile. By using an ink jet printing apparatus (hereinafter also referred to simply as a printing apparatus) as the image forming apparatus to which the present invention can be applied, embodiments of the present invention will be described with reference the attached drawings.

(Printing Apparatus)

Figure 1:
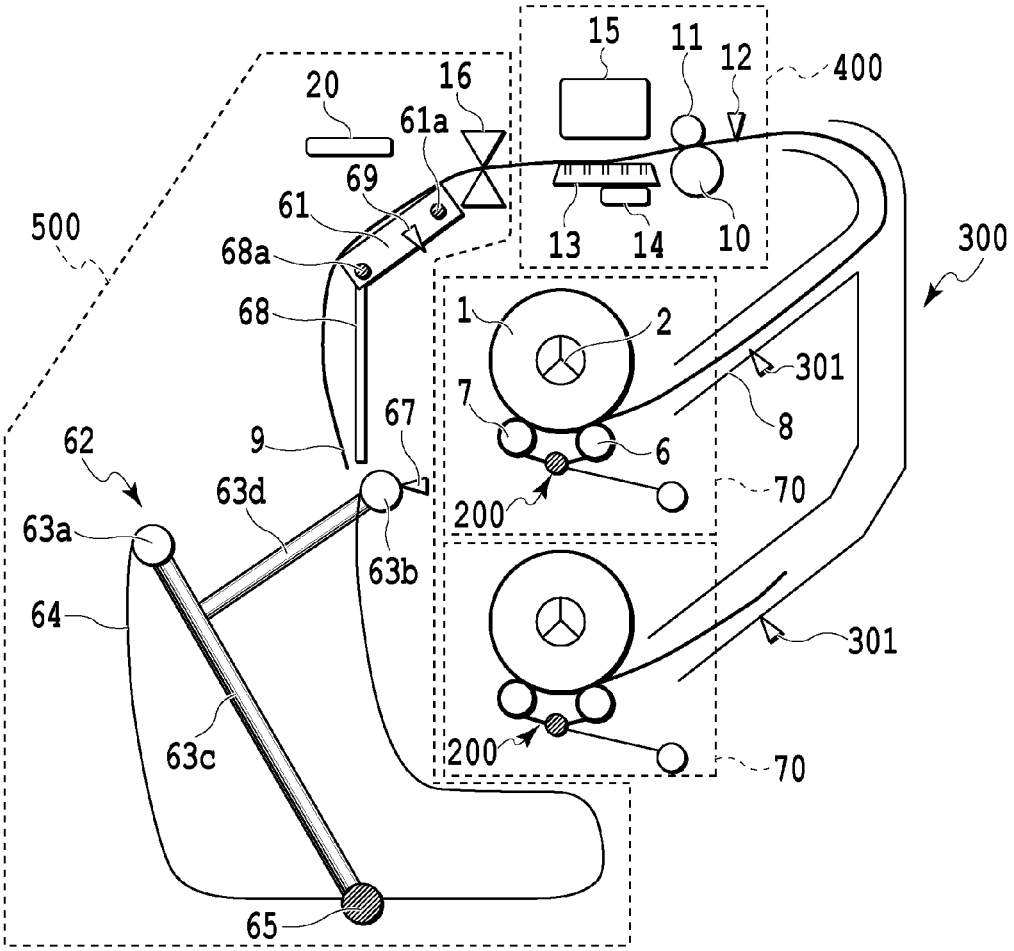
FIG. 1 is a view showing a configuration of a printing apparatus in a first usage form according to one embodiment.

A printing apparatus shown in FIG. 1 has two conveying units 70 (upper and lower conveying units 70) arranged in a vertical direction, a sheet conveying unit 300, a printing unit 400, and a sheet discharge unit 500. A sheet 1 is used as a print medium, and a long continuous sheet wound in a roll is attached to the conveying unit 70. In the present specification, the continuous sheet wound in a roll will also be referred to as a roll sheet 1.

The conveying unit 70 selectably has a function, as a supply unit, of drawing and supplying the sheet 1 from a roll portion of the attached roll sheet 1 and a function, as a winding unit, of winding up the sheet 1 printed in the printing unit 400 into a roll.

In the present specification, a usage form in a case where both of the upper and lower conveying units 70 are used as supply units is referred to as a "first usage form." Meanwhile, a usage form in a case where one of the upper and lower conveying units 70 is used as a supply unit and the other is used as a winding unit is referred to as a "second usage form."

(First Usage Form)

First, a description will be given of the usage form in a case where both of the upper and lower conveying units 70 are used as supply units (first usage form).

In FIG. 1, a spool member (roll member) 2 is inserted into a paper core of the roll sheet 1 and is axially supported by a holding unit of the conveying unit 70. A rotational force is applied, by a roll drive motor (driving unit), to the spool member 2 which is axially supported by the holding unit of the conveying unit 70, and this allows the spool member 2 to rotate in forward and backward directions. A plurality of auxiliary mechanisms 200 are provided in a sheet width direction, each having rollers 6 and 7 (rotators) arranged in a sheet supply direction. In a case where the conveying unit 70 is used as a supply unit, the auxiliary mechanism 200 serves as a sheet supply auxiliary mechanism. A conveying guide 8 guides both the front and back sides of the sheet 1 that has been supplied from the conveying unit 70 and leads the sheet 1 to the printing unit 400.

A conveying roller 10 is rotatable in the forward and backward directions by a conveying roller drive motor. A conveying pinch roller 11 can be driven to rotate relative to the rotation of the conveying roller 10. A conveying pinch roller separation motor (not shown) can switch the conveying pinch roller 11 between a separation state and a contact state relative to the conveying roller 10 and can change a nip pressure (pressing force) in the contact state.

Sheet leading end detection sensors 12 and 301 detect a leading end of the sheet 1 supplied from the conveying unit 70. Detection of the leading end of the sheet 1 triggers rotation control of the above-mentioned roll drive motor, conveying roller drive motor, and conveying pinch roller separation motor or is used for detection of a paper jam. A platen 13 sucks and attaches the back side of the sheet 1 with a negative pressure generated by a suction fan 14 so that printing can be performed by a print head 15 with high precision.

The sheet discharge unit 500 cuts, by a cutter 16, the sheet 1 when printing is finished, and stores the cut printed sheet 1 in a basket unit 62.

A paper discharge guide 61 supports the back side of the printed sheet 1 and guides the printed sheet 1. The paper discharge guide 61 is rotatable around a rotation center 61*a*. In a case where the roll sheet 1 is attached to the upper conveying unit 70, in FIG. 1, the paper discharge guide 61 is rotated in a clockwise rotation direction around the rotation center 61*a* from the state shown in FIG. 1 to form a space at the front of the printing apparatus. The roll sheet 1 can be attached from that space.

A guide member 68 is a movable guide member which extends downward in a vertical direction from an end portion of the paper discharge guide 61 and is rotatably attached to the paper discharge guide 61 around an axis 68*a*. It should be noted that in FIG. 1, the movable guide member 68 rotates in a counterclockwise direction around the axis 68*a* from the state shown in FIG. 1 to be housed in the paper discharge guide 61. The paper discharge guide 61 is provided with a position detection sensor 69 which detects that the movable guide member 68 is housed in the paper discharge guide 61.

The basket unit 62 includes rods 63*a* to 63*d* as a structure body (frame) and a bag cloth 64 in which the discharged sheet 1 can be stored. The basket unit 62 is rotatable around a rotation center 65. In a case where the roll sheet 1 is attached to the lower conveying unit 70, in FIG. 1, the basket unit 62 is rotated in the counterclockwise rotation direction around the rotation center 65 from the state shown in FIG. 1 to form a space at the front of the printing apparatus. The roll sheet 1 can be attached from that space.

Figure 2C:
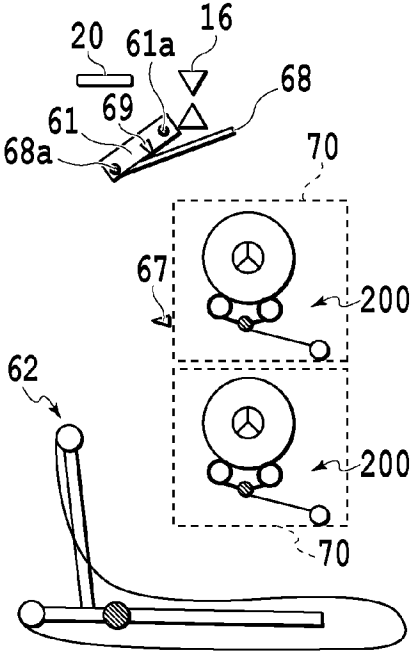
FIGS. 2A to 2C are views showing a movable configuration of a sheet discharge unit of the printing apparatus according to the embodiment.
Figure 2B:
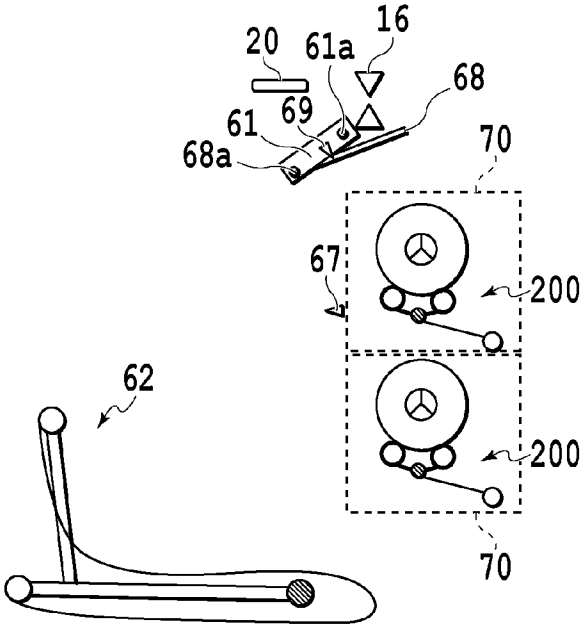

A position detection sensor 67 of the basket unit 62 detects ON if the basket unit 62 is set as shown in FIG. 1 and detects OFF if the basket unit 62 is rotated and is not in the state shown in FIG. 1, for example, when the basket unit 62 is in the states shown in FIGS. 2B and 2C.

To an operation panel 20, a user inputs the type of roll sheet 1 or the like.

(Configuration of Setting a Roll Sheet)

Figure 3A:
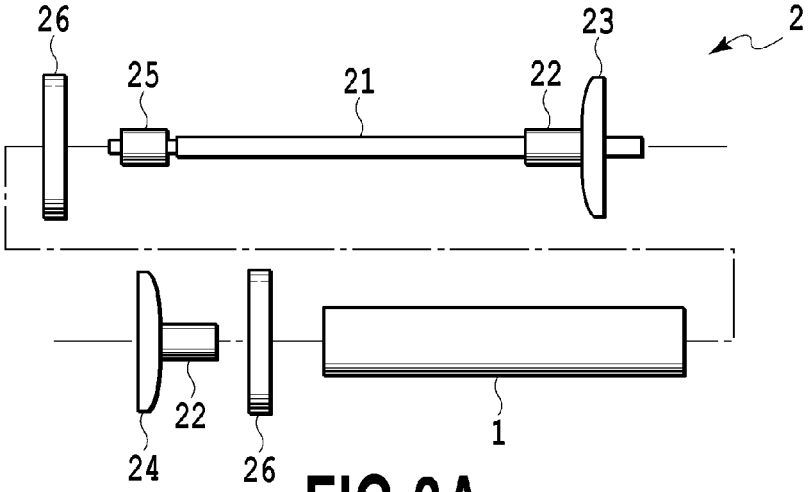
FIGS. 3A and 3B are views showing a spool member in the first usage form.
Figure 3B:
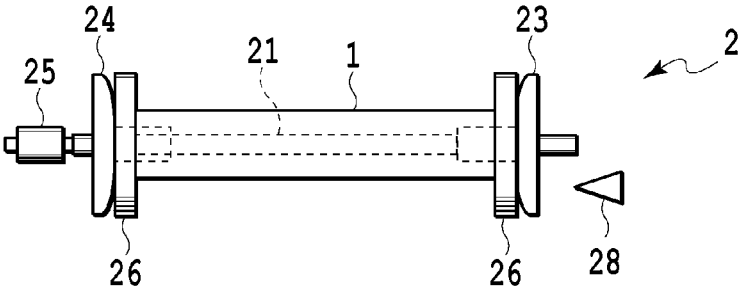
Figure 3C:
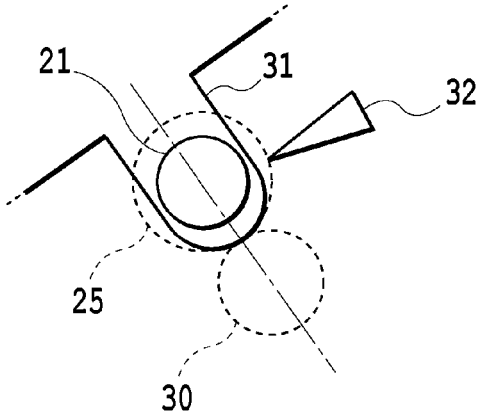
FIG. 3C is a view showing the spool member and a mounting unit of the spool member in the first usage form.

With reference to FIGS. 3A to 3C, a description will be given of a configuration and a procedure of setting the roll sheet 1 on the printing apparatus. FIG. 3A is a front view of the spool member 2 in a disassembled state. FIG. 3B is a front view of the spool member 2 in an assembled state. FIG. 3C is a schematic cross-sectional view of an attachment unit for the roll sheet 1 in the side of the printing apparatus body.

In FIG. 3A, the spool member 2 includes a spool shaft 21, a friction member 22, a reference spool flange 23, a non-reference spool flange 24, a spool gear 25, and a supply flange attachment 26.

The supply flange attachment 26 is removably attached to the reference spool flange 23 and the non-reference spool flange 24 by a hook having a spring property or the like. In the first usage form in which the conveying units 70 are kept being used as supply units, the supply flange attachment 26 does not need to be detached from the reference spool flange 23 and the non-reference spool flange 24. The supply flange attachment 26, the reference spool flange 23, and the non-reference spool flange 24 may be integrally handled. As will be described later, it should be noted that in a case where the conveying unit 70 is used as a winding unit in the second usage form, the supply flange attachment 26 needs to be detached.

The non-reference spool flange 24 and the supply flange attachment 26 which are fitted to the spool shaft 21 are integrally detached, and the spool shaft 21 is inserted into the paper core of the roll sheet 1. At this time, since there is a sufficient space between an inner diameter of the paper core of the roll sheet 1 and an outer diameter of the spool shaft 21, a user can fit the roll sheet 1 to the spool shaft 21 by a small power. At the point when an end portion of the roll sheet 1 comes into contact with the supply flange attachment 26 in the side of the reference spool flange 23, the friction member 22 provided on the inner side of the reference spool flange 23 in the usage position comes into contact with the inner surface of the paper core of the roll sheet 1.

The non-reference spool flange 24 and the supply flange attachment 26 which have been detached are integrally engaged in the spool shaft 21, and the friction member 22 provided on the inner side of the non-reference spool flange 24 in the usage position is brought into contact with the inner surface of the paper core of the roll sheet 1. Accordingly, the paper core of the roll sheet 1 is locked and its movement relative to the spool member is prevented. The resulting state is shown in FIG. 3B, and the spool member 2 to which the roll sheet 1 is mounted is set on the printing apparatus body. A reflection type sensor 28 is provided for the printing apparatus body, and determines whether the supply flange attachment 26 is in the attached state or not in the attached state.

In FIG. 3C, a spool holder 31 is provided on each of the reference side and the non-reference side of the printing apparatus body and has a U-shaped cross-section. The spool member 2 may be fitted to or detached from a U-shaped opening of the spool holder 31. A U-shaped bending portion has a diameter to mate with the spool shaft 21. The spool gear 25 provided to rotate the spool member 2 is connected to a spool drive unit 30 on the side of the printing apparatus body to transmit the driving. The rotation operation of the spool member 2 allows a supply operation or a winding operation of the roll sheet 1. The printing apparatus can detect the presence or absence of the spool member 2 by using a spool presence/absence detection sensor 32.

(Auxiliary Mechanism)

Figure 4A:
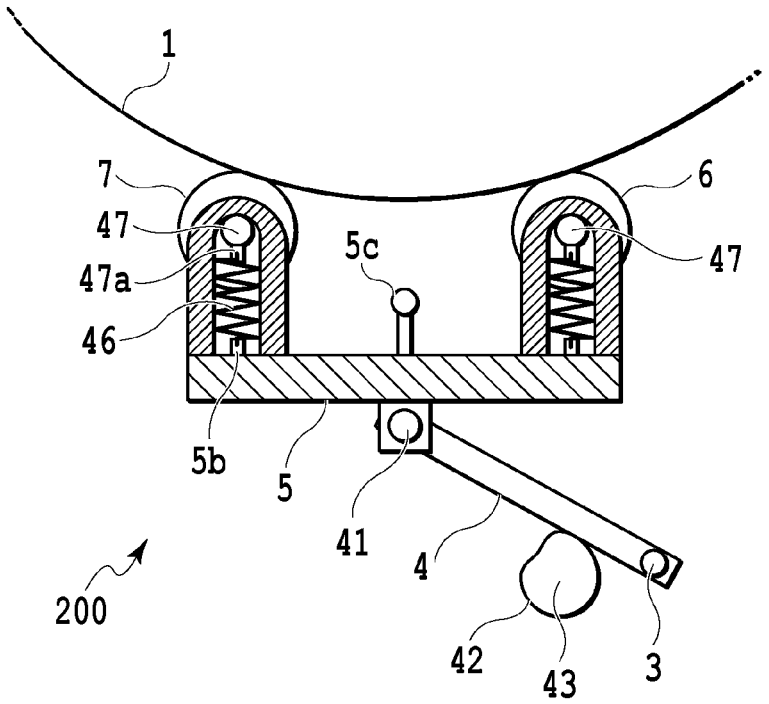
FIGS. 4A and 4B are views showing a sheet supply auxiliary mechanism/winding auxiliary mechanism.
Figure 4B:
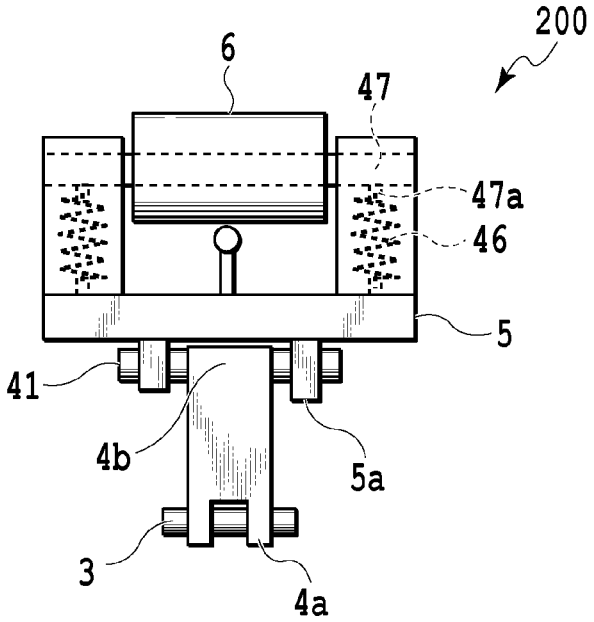

With reference to the schematic views shown in FIGS. 4A and 4B, a description will be given of a detailed configuration of an auxiliary mechanism 200 according to the present embodiment. FIG. 4A shows a cross section of the auxiliary mechanism 200 taken along the sheet supply direction of the printing apparatus. FIG. 4B shows a side of the auxiliary mechanism 200 as viewed from a downstream side of the sheet supply direction.

A rotation shaft 3 rotatably engages with the printing apparatus body and serves as a rotation shaft of the whole auxiliary mechanism 200. The auxiliary mechanism 200 rotates around the rotation shaft 3. The rotation shaft 3 rotatably engages with a portion 4*a* of an arm portion 4, and both ends of the rotation shaft 3 are restricted in a thrust direction by a ring member (not shown). The arm portion 4 slidably engages with a shaft member 41 in a portion 4*b*, and is positioned by urging a rotary cam 42 under the weight of the whole auxiliary mechanism 200. The rotary cam 42 rotatably engages with a shaft member 43, touches a surface of the arm portion 4, and rotates by the driving from a driving mechanism (pressure drive motor), so as to change the position of the arm portion 4.

A swinging member 5 rotatably engages with the shaft member 41 in an engaging unit 5*a*, and both ends of the shaft member 41 are restricted in the thrust direction by a ring member (not shown). A driven rotation roller 6 and a sheet presser roller 7 are provided above the swinging member 5. The rollers 6 and 7 are pressed against the roll sheet 1. On the swinging member 5, a roll outer diameter detection sensor 5*c* is arranged on a center portion between the driven rotation roller 6 and the sheet presser roller 7 to detect a distance from the roll sheet 1. Each of the driven rotation roller 6 and the sheet presser roller 7 rotatably engages with a shaft member 47, and both ends of the driven rotation roller 6 and the sheet presser roller 7 are restricted in the thrust direction by a ring member (not shown).

The shaft member 47 is fitted to an upper hole portion of the swinging member 5 and has a protrusion 47*a*. A compression spring 46 is fitted to the protrusion 47*a* of the shaft member 47 and a protrusion 5*b* of the swinging member 5 and is restricted, and urges the shaft member 47 in an upper direction. The two rollers 6 and 7 are arranged to have an equal distance from the center position of the swinging member 5 and swing and rotate around the shaft member 41, so that the pressing forces against the roll sheet 1 are uniform. Providing a plurality of rollers in an outer peripheral direction of the roll sheet 1 can effectively suppress expansion of the diameter of the roll portion of the roll sheet 1 and loosening of the winding. By rotating the roll sheet 1 via the spool member 2 in a state in which the rollers 6 and 7 are pressed against an outer peripheral surface of the roll sheet 1, the sheet 1 is conveyed with a friction force of the roll sheet 1 itself. The auxiliary mechanism 200 pressurizes the sheet from a side below a horizontal surface which passes the center of the roll sheet 1, that is, from a side below the roll sheet 1 in a vertical direction.

According to the above configuration of the auxiliary mechanism 200, a warp of the roll sheet 1 having both ends supported by the spool member 2 is corrected, and conveyance precision that is higher than that in sheet supply can be obtained.

An operation area of the auxiliary mechanism 200 acting as a pressure mechanism with respect to the roll sheet 1 is below the roll sheet 1 in the vertical direction. Accordingly, it is possible to secure a space for setting a sheet when a heavy roll sheet is set, and the auxiliary mechanism 200 does not interfere with the setting operation.

Further, a conveying path of the sheet conveying unit 300 has a U-turn shape which starts from the lower side, whereas the conveying unit 70 uses a system which pressurizes the roll sheet 1 from the lower side. This system allows the sheet 1 to be supplied in a manner following the curl of the roll sheet 1. Therefore, it is possible to minimize a conveying resistance in supplying and prevent a sheet surface from being scratched.

(Sheet Discharge Unit)

With reference to the schematic cross-sectional views of the printing apparatus shown in FIGS. 2A to 2C and the perspective view of the printing apparatus shown in FIG. 8, a description will be given of a detailed configuration of the sheet discharge unit 500.

Figure 2A:
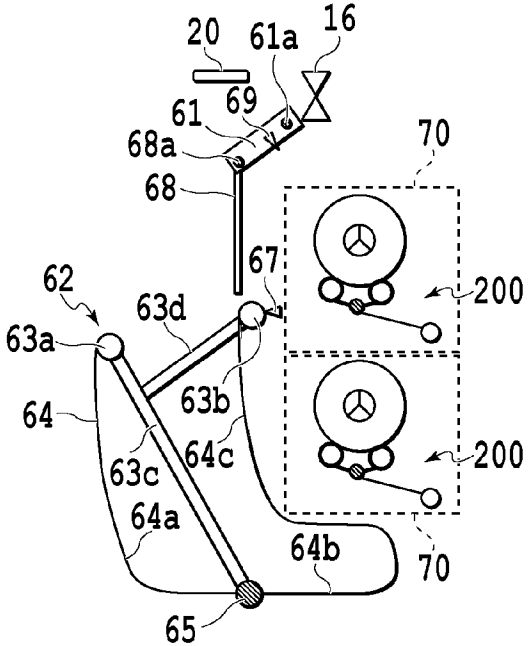
Figure 8:
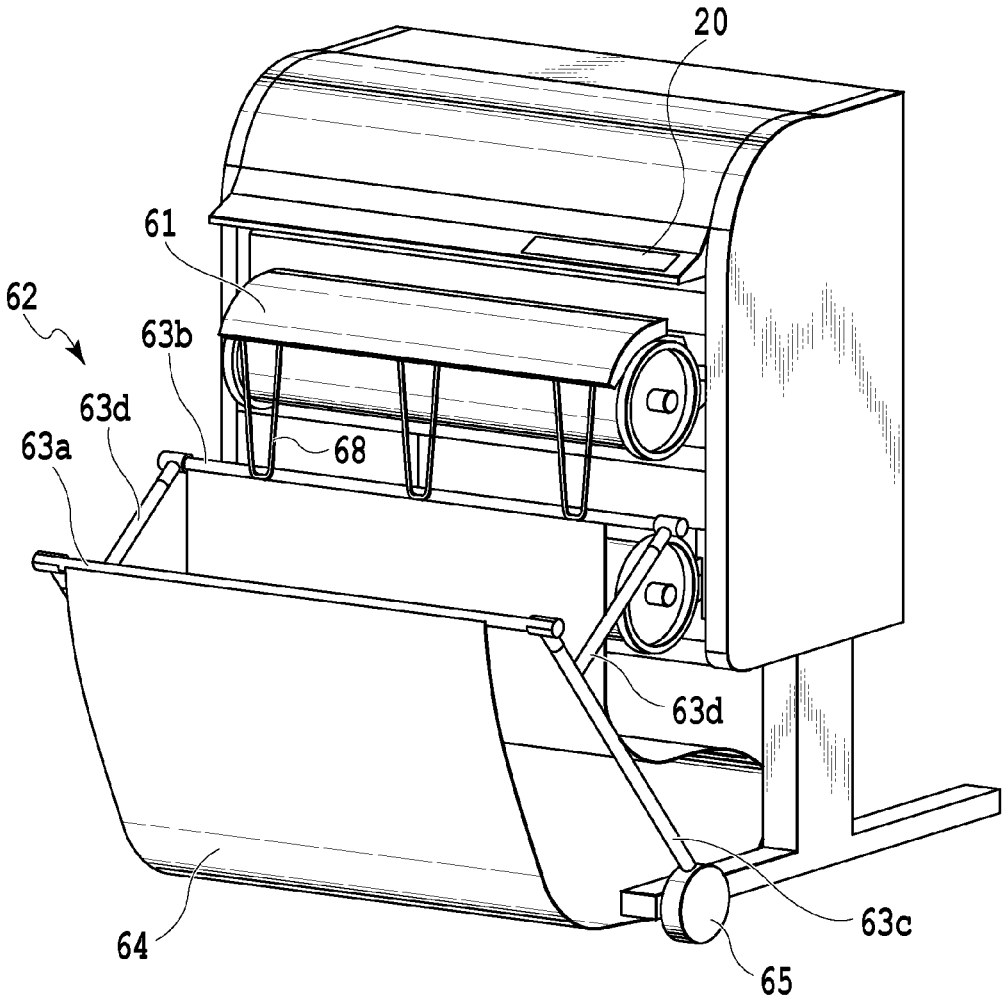
FIG. 8 is a perspective view of the printing apparatus as viewed from a side of the sheet discharge unit.

FIGS. 2A and 8 show a state in which the basket unit 62 is set in an available state in the sheet discharge unit 500. FIG. 2B shows a state in which the movable guide member 68 is housed in the paper discharge guide 61 and a basket portion of the basket unit 62 is closed. FIG. 2C shows a state in which the basket unit 62 is housed below the lower conveying unit 70.

In the present example, the paper discharge guide 61 is a mold component which forms a guide across the entire area in the sheet width direction. The movable guide member 68 is formed by forming/bending wires, and has two positions: a position in which the movable guide member 68 hangs under its own weight in the vertical direction and a position in which the movable guide member 68 is housed in the paper discharge guide 61. Further, the paper discharge guide 61 is provided with the position detection sensor 69 for detecting that the movable guide member 68 is housed. The position detection sensor 69 detects OFF if the movable guide member 68 hangs under its own weight as shown in FIG. 2A and detects ON if the movable guide member 68 is housed as shown in FIGS. 2B and 2C.

The basket unit 62 includes the rods 63*a* to 63*d* as a structure body (frame) and the bag cloth 64 in which the discharged sheet is stored.

The thrust direction (axial direction) of the rods 63*a* and 63*b* is the same as the sheet width direction. Each end of the rod 63*a* is connected to one end of the two rods 63*c*. Each end of the rod 63*b* is connected to one end of the two rods 63*d*. The other end of the rod 63*d* is connected to the rod 63*c*. The other end of the rod 63*c* is rotatably attached to the rotation center 65 provided for a stand, and the rod 63*c* can rotate to the position substantially horizontal as shown in FIG. 2B. From this state, the rod 63*c* is further movable in the thrust direction and can be housed below the lower conveying unit 70 as shown in FIG. 2C.

The position detection sensor 67 for detecting a state of the basket unit 62 detects ON if the basket unit 62 is set as shown in FIG. 2A and detects OFF if the basket unit 62 is not set as shown in FIGS. 2B and 2C.

In the set state shown in FIG. 2A, the bag cloth 64 includes a portion 64*a* on the front side of the printing apparatus, a portion 64*b* on the floor side, and a portion 64*c* on the side of the back of the sheet to be discharged. The discharged sheet is received mainly by the portions 64*a* and 64*b*, so as to prevent the printed surface from touching the ground and being smudged. The portion 64*c* has a function of guiding the back of the sheet during printing or discharging, and continuously guides the sheet from the paper discharge guide 61 and the movable guide member 68 so as to prevent the discharged sheet from entering the conveying unit 70. If the discharged sheet enters the conveying unit 70, a jam (paper jam) may occur. Accordingly, in a case where the position detection sensor 67 for detecting the state of the basket unit 62 or the position detection sensor 69 for detecting the state of the movable guide member 68 detects OFF indicating that either the basket unit 62 or the movable guide member 68 is housed, a warning is given to the user by the operation panel 20. It should be noted that this is the case of the first usage form in which the conveying units 70 are used as supply units and the sheet is discharged to the basket. The second usage form in which the conveying unit 70 is used as a winding unit will be described later.

(Control System)

Figure 16:
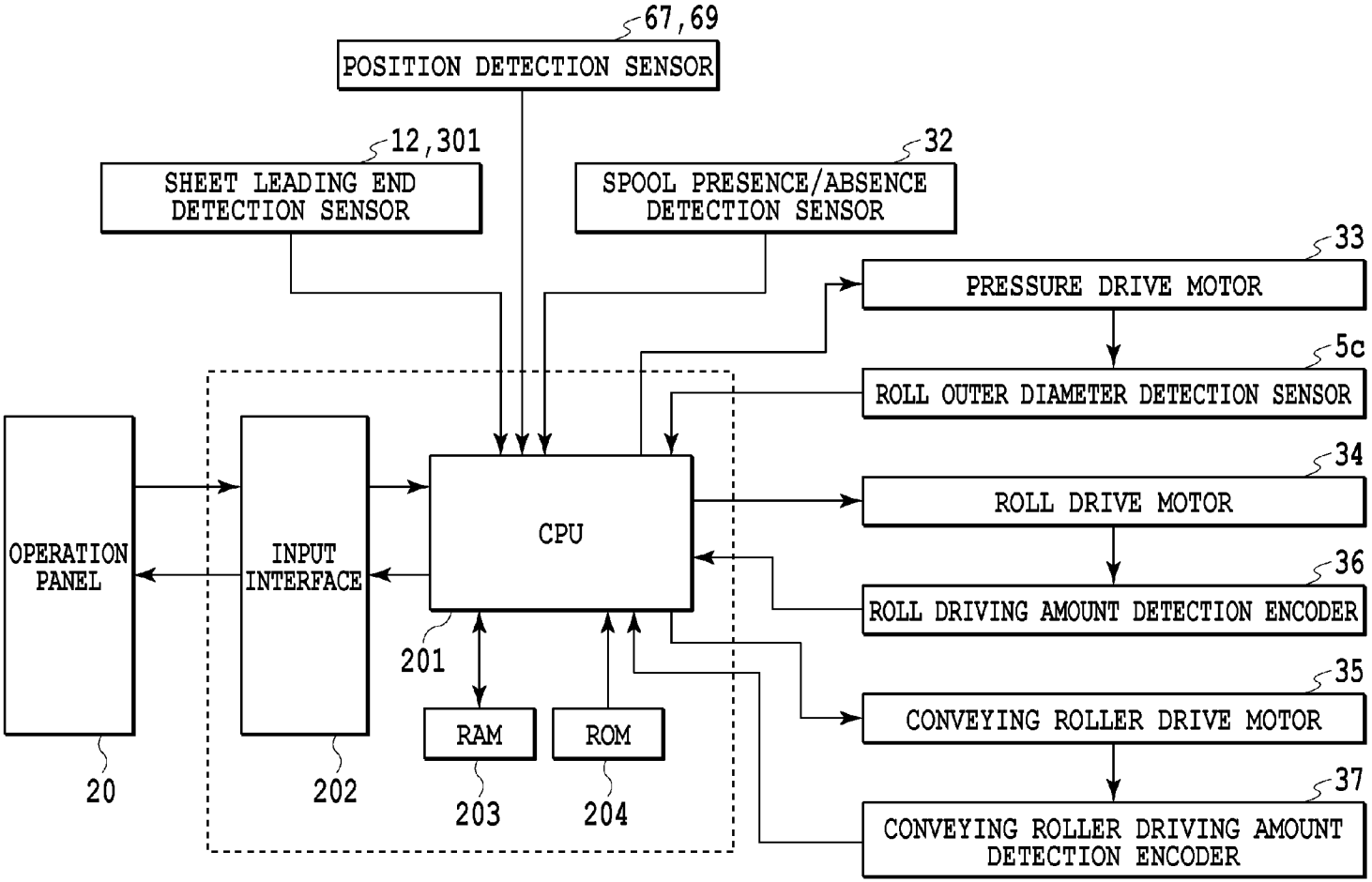
FIG. 16 is a block diagram showing an example of a control system.

With reference to FIG. 16, a description will be given of a control system according to the present embodiment. FIG. 16 is a block diagram showing a configuration of the control system in the present embodiment. A CPU 201 controls the conveying units 70 and the printing unit 400 according to a control program stored in a ROM 204. To the CPU 201, application selection information indicating whether the conveying unit 70 is for a supply use or for a winding use is inputted from the operation panel 20 via an input interface 202. The inputted application selection information is written to or read from a RAM 203.

The CPU 201 receives detection results of the spool presence/absence detection sensor 32 and the sheet leading end detection sensors 12 and 301 and ON/OFF signals from the position detection sensors 67 and 69 of the basket unit 62 and the movable guide member 68. Further, the CPU 201 receives a trigger signal or the like involving a user operation from the operation panel 20. Based on the received detection results and signals, the CPU 201 executes processing in connection with operation sequences (described later) according to a predetermined control program stored in the ROM 204.

More specifically, the CPU 201 sends a rotation control signal to a pressure drive motor 33 of the upper and lower conveying units 70 to drive the pressure drive motor 33. The auxiliary mechanism 200 rotates according to the operation of the pressure drive motor 33. The CPU 201 receives a signal from the roll outer diameter detection sensor 5*c* and controls driving and stopping of the pressure drive motor 33.

The CPU 201 further sends a rotation control signal also to a roll drive motor 34 and a conveying roller drive motor 35 of the upper and lower conveying units 70. In response to the operations of the roll drive motor 34 and the conveying roller drive motor 35, the CPU 201 receives signals from driving amount detection encoders 36 and 37 of the motors, and performs rotation control of the motors 34 and 35. It should be noted that in the control of the motors provided for the upper and lower conveying units 70, since a control program in the case of using the conveying unit 70 for a supply application and a control program in the case of using the conveying unit 70 for a winding application are different, either control is performed by sequentially referring to the application selection information stored in the RAM 203.

(Operation Sequence in Sheet Supply)

Figure 5:
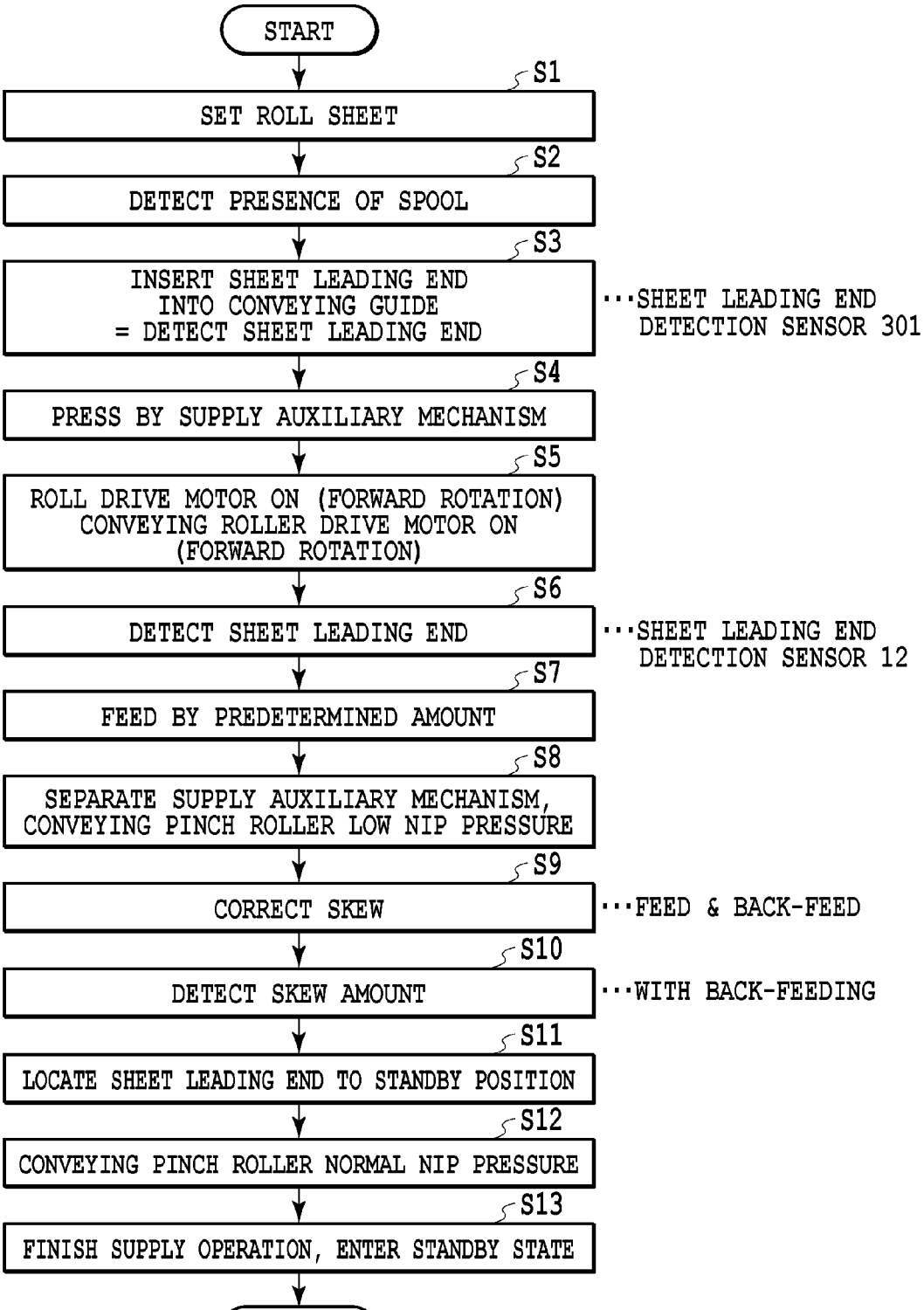
FIG. 5 is a flow showing an operation sequence in sheet supply according to a first embodiment.

With reference to FIG. 5, a description will be given of a flow of an operation sequence in sheet supply according to a first embodiment. In the following description, signs in parentheses indicate numbers of steps in the flow shown in the figure. A description will be given based on the following: rotation in the sheet supply direction is defined as forward rotation and rotation in a direction opposite to the forward direction is defined as backward rotation.

The spool member 2 is inserted into the paper core of the roll sheet 1 and set on the conveying unit 70 (S1). The spool presence/absence detection sensor 32 provided for the spool holder 31 detects the presence of the spool member 2 (S2). With the detection of the presence of the spool member 2, a message of the detection is announced on the operation panel. If the user inserts a leading end 9 of the sheet 1 into the conveying guide 8, the sheet leading end detection sensor 301 detects the leading end 9 of the sheet 1 (S3). Then, the auxiliary mechanism 200 rotates by the pressure drive motor 33 and presses the roll sheet 1.

In this example, driving the pressure drive motor 33 in the forward direction causes the auxiliary mechanism 200 to operate in a direction in which the auxiliary mechanism 200 comes closer to the roll sheet 1, and driving the pressure drive motor 33 in the backward direction causes the auxiliary mechanism 200 to operate in a direction in which the auxiliary mechanism 200 is separated from the roll sheet 1. The roll outer diameter detection sensor 5*c* detects a distance between a surface of the roll sheet 1 and the auxiliary mechanism 200 acting as a pressure mechanism, and the pressure drive motor 33 stops at an appropriate pressing position. Controlling a direction and an amount of the driving of the pressure drive motor 33 can change a pressing force of the auxiliary mechanism 200 against the roll sheet 1. That is, the auxiliary mechanism 200 can be in contact with or be separated from the roll sheet 1, and various levels of the pressing force when the auxiliary mechanism 200 is in contact with the roll sheet 1 can be set. States of the pressing can be arbitrarily changed in the middle of the sequence according to the situation.

Then, the printing apparatus performs a sheet conveying operation. More specifically, driving of the roll drive motor 34 and the conveying roller drive motor 35 in the forward rotation direction is started, and sheet conveyance is started (S5). The sheet leading end detection sensor 12 detects the leading end 9 of the sheet 1 which has been drawn from the roll portion of the roll sheet 1 (S6). The sheet 1 is then fed by a predetermined amount and delivered to pass the conveying roller 10 (S7). Then, the auxiliary mechanism 200 is separated from the roll sheet 1, and at the same time, a nip pressure of the conveying pinch roller 11 with respect to the conveying roller 10 is set to a low nip pressure which is lower than a normal nip pressure, that is, a nip pressure used in printing (S8). Then, skew of the sheet 1 is corrected by repeating back-feeding and feeding of the sheet 1 (S9).

It should be noted that in the present specification, the term feeding indicates conveyance in a sheet conveying direction while printing of the sheet is performed (corresponding to a supply direction), whereas the term back-feeding indicates conveyance in a direction opposite to the sheet conveying direction while printing of the sheet is performed (corresponding to a winding-back direction).

Then, while back-feeding the sheet 1, a sensor (not shown) captures a position of the leading end 9 of the sheet 1 and detects a skew amount (S10), and the sheet 1 is stopped such that the leading end 9 of the sheet 1 is located at a standby position before printing is started (S11). Then, a nip pressure of the conveying pinch roller 11 with respect to the conveying roller 10 is returned to a normal nip pressure (S12), and the supply operation is finished (S13).

(Operation Sequence in Printing in the First Usage Form)

Next, with reference to FIG. 6, a description will be given of a flow of an operation sequence in printing in the first usage form according to the first embodiment. In the following description, signs in parentheses indicate numbers of steps in the flow shown in the figure. It should be noted that since the sequence is started from the operation end state in sheet supply (S13 in FIG. 5) as described above, the auxiliary mechanism 200 is being separated from the roll sheet 1, and a nip pressure of the conveying pinch roller 11 with respect to the conveying roller 10 is a normal nip pressure.

If print data is received from a PC or the like (S14), driving of the conveying roller drive motor 35 in the forward rotation direction is started, and sheet conveyance is started (S15). The leading end 9 of the sheet at the standby position is fed to a position immediately below the print head 15 (S16). Then, the print head 15 scans the sheet in the width direction and ejects ink to perform printing (S17).

More specifically, after the print head 15 scans the sheet in a forward direction to perform printing corresponding to one line, the conveying roller 10 feeds the sheet 1 by a predetermined amount, and then the print head 15 scans the sheet 1 in a backward direction to perform printing corresponding to one line. In this manner, printing is performed by repeating the forward and backward operations of the print head 15 and the feeding operation of the conveying roller 10 while conveying the sheet 1 to the downstream side. At this time, along with the feeding operation by the conveying roller 10, the roll drive motor (driving unit) is controlled to be driven in the backward rotation direction. In the control of the roll drive motor 34, a driving force is suppressed with current restriction, and accordingly, the sheet 1 is pulled by the conveying roller 10 with a force which is equal to or greater than the driving force of the conveying roller 10. Such control is performed so as to apply an appropriate back tension to the roll sheet 1 and achieve stable conveyance without a sag.

If printing is finished (S18), the conveying roller 10 feeds the sheet 1 until a trailing end of a printed portion comes to a cut position of the cutter 16 (S19), and a cutter drive motor (not shown) activates the cutter 16 to perform cutting (S20). A cut printed material is stored in the basket unit 62. The sheet 1 that is left on the printing apparatus side is back-fed by a predetermined amount by the conveying roller 10 (S21), and a new leading end 9 of the sheet 1 produced by the cutting is returned to a print start standby position, and the printing apparatus enters a standby state (S22).

(Operation Sequence in Sheet Winding-Back)

Figure 6:
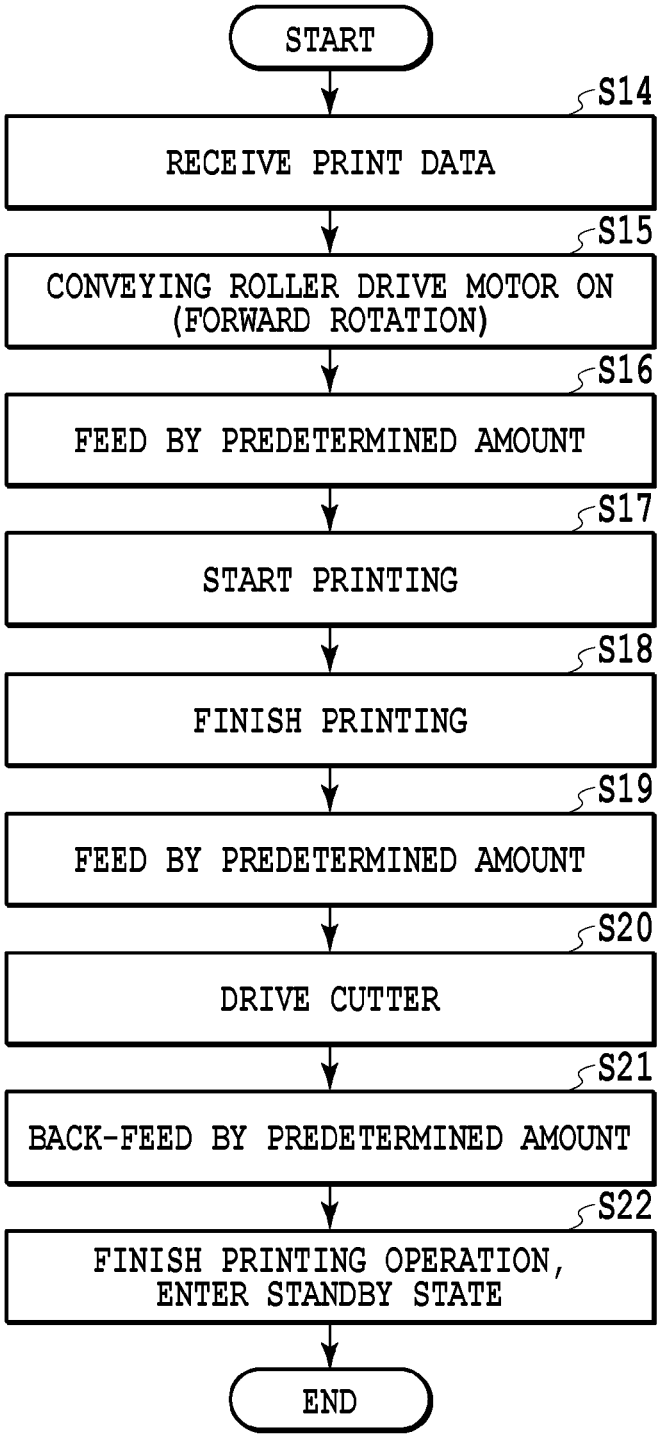
FIG. 6 is a flow showing an operation sequence in printing in the first usage form.
Figure 7:
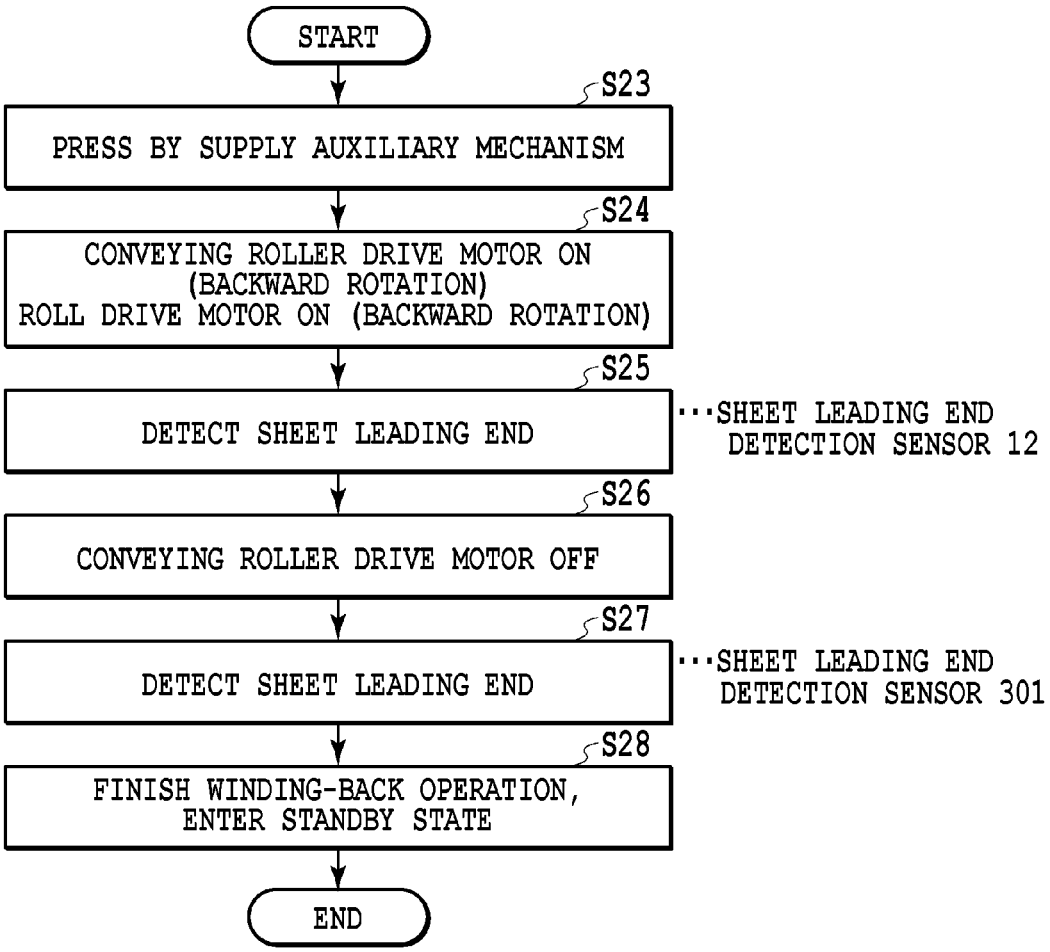
FIG. 7 is a flow showing an operation sequence in sheet winding-back.

With reference to FIG. 7, a description will be given of an example of a flow of an operation sequence to wind back the sheet 1. In the following description, signs in parentheses indicate numbers of steps in the flow shown in the figure. It should be noted that the term winding-back as used in the present specification indicates an operation of back-feeding the sheet 1 from a state in which the leading end 9 of the sheet 1 is located near the conveying roller 10 (for example, the standby state as described in S13 of FIG. 5 and S22 of FIG. 6) to a state in which the leading end 9 of the sheet 1 comes near a supply port of the conveying unit 70.

First, the auxiliary mechanism 200 presses the roll sheet 1 (S23). This is to avoid loosening of the winding of the roll sheet 1 in the conveying unit 70 as a supply unit. In this state, the roll drive motor 34 and the conveying roller drive motor 35 are driven in the backward rotation direction at the same time (S24) to back-feed the sheet 1. After a while, the leading end 9 of the sheet 1 passes the detection position of the sheet leading end detection sensor 12 (S25), and accordingly, driving of the conveying roller drive motor 35 is stopped (S26). The roll drive motor 34 is kept driven, and the sheet 1 is further back-fed. Then, the leading end 9 of the sheet 1 passes the detection position of the sheet leading end detection sensor 301 (S27). After that, the roll drive motor 34 is stopped, and the winding-back operation is finished (S28).

It should be noted that in a case where the sheet 1 is wound up to the end for the purpose of replacement of the roll sheet or the like, the roll drive motor is kept driven even after the sheet 1 passes the detection position of the sheet leading end detection sensor 301, and the sheet 1 is back-fed until the leading end 9 of the sheet 1 is released from the conveying guide 8.

Meanwhile, for example, in a case where the roll sheet used for printing is switched between the upper and lower units, the sheet 1 does not need to be wound up to the end. More specifically, after the leading end 9 of the sheet 1 passes the detection position of the sheet leading end detection sensor 301, the roll drive motor 34 is stopped immediately, and the leading end 9 of the sheet 1 is made to wait close to the sheet leading end detection sensor 301. At this time, the auxiliary mechanism 200 maintains a pressing state with respect to the roll sheet 1 to prevent the sheet 1 from dropping from the conveying guide 8 under its own weight.

To avoid loosening of the winding of the roll sheet 1 and to prevent the sheet 1 from dropping from the conveying guide 8, pressing forces of the auxiliary mechanisms 200 in sheet supply may be the same or different. For example, by setting a pressing force for avoiding loosening of the winding and dropping to a pressing force that is greater than that in sheet supply, it is possible to increase an effect of prevention of dropping or the like without affecting precision of sheet conveyance in supplying and damage to the surface of the roll sheet.

A description has been given of the case of the first usage form in which both of the upper and lower conveying units 70 are used as supply units. Next, a description will be given of the case of a second usage form in which one of the conveying units 70 is used as a winding unit.

(Second Usage Form)

With reference to the drawings, a description will be given of the case where the upper conveying unit 70 is used as a supply unit and the lower conveying unit 70 is used as a winding unit (second usage form). It should be noted that a description of the configuration and the operation that are the same as those of the above-described first usage form will be omitted.

Figure 9:
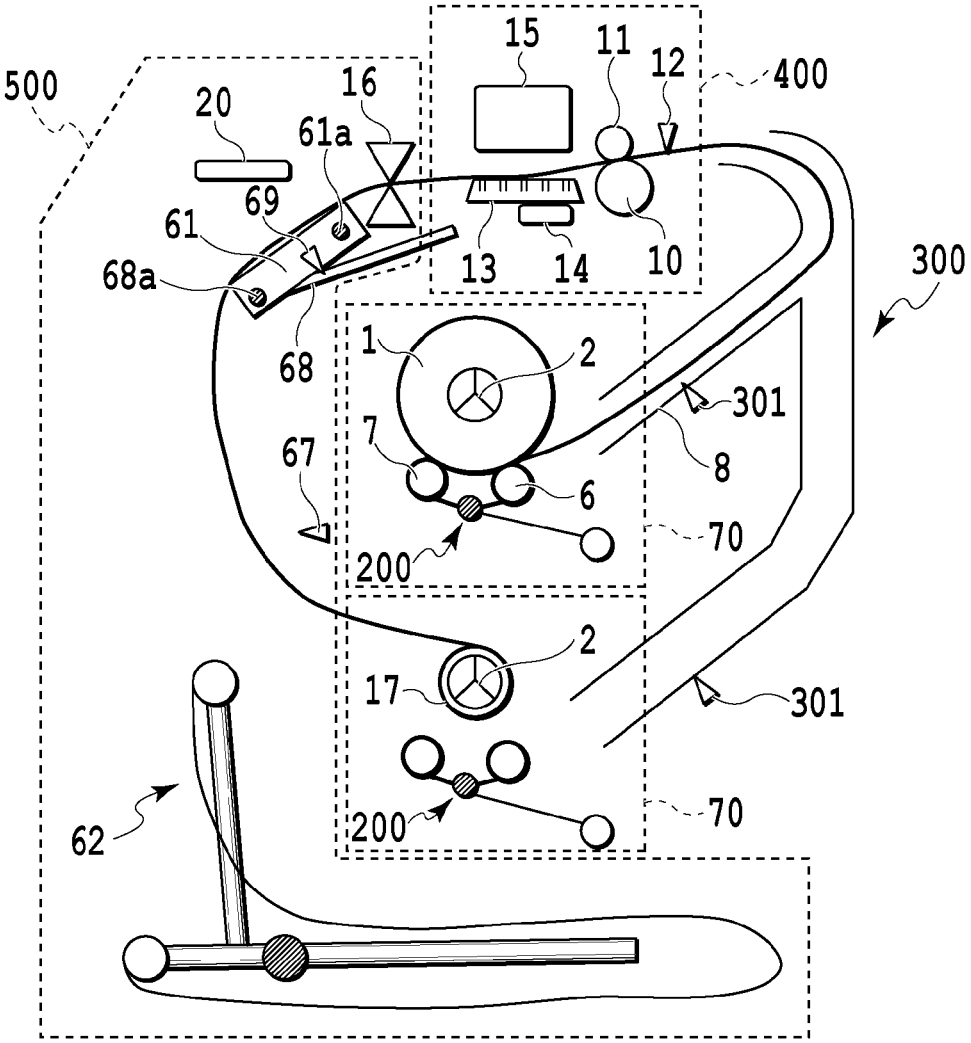
FIG. 9 is a view showing a configuration of the printing apparatus in a second usage form.

In FIG. 9, in the case of using the lower conveying unit 70 as a winding unit, the paper core 17 for sheet winding is attached to the spool member 2, and the leading end 9 of the sheet 1 is fixed to the paper core 17 by using a tape or the like, and the sheet 1 that has been conveyed is wound up. Since the movable guide member 68 and the basket unit 62 are obstruction in the state shown in FIG. 2A, they are used in the positions at which they are housed. That is, in the second usage form, the position detection sensor 69 of the movable guide member 68 is ON and the position detection sensor 67 of the basket unit 62 is OFF.

In this example, in a case where the conveying unit 70 is used as a supply unit, the auxiliary mechanism 200 serves as a "sheet supply auxiliary mechanism" which assists supply of a sheet. Meanwhile, in a case where the conveying unit 70 is used as a winding unit, the auxiliary mechanism 200 is pressed against or separated from the surface of the wound sheet 1 in setting the sheet on the paper core, in printing, or in end processing, so as to serve as a "sheet winding auxiliary mechanism" which assists winding of a sheet. In the present specification, depending on application of the conveying unit 70, that is, depending on the usage form, the auxiliary mechanism 200 is also referred to as a supply auxiliary mechanism 200 or a winding auxiliary mechanism 200.

(Configuration to Set the Paper Core)

With reference to FIGS. 10A to 11B, a description will be given of a configuration of setting the paper core 17 for sheet winding on the printing apparatus.

Figure 10A:
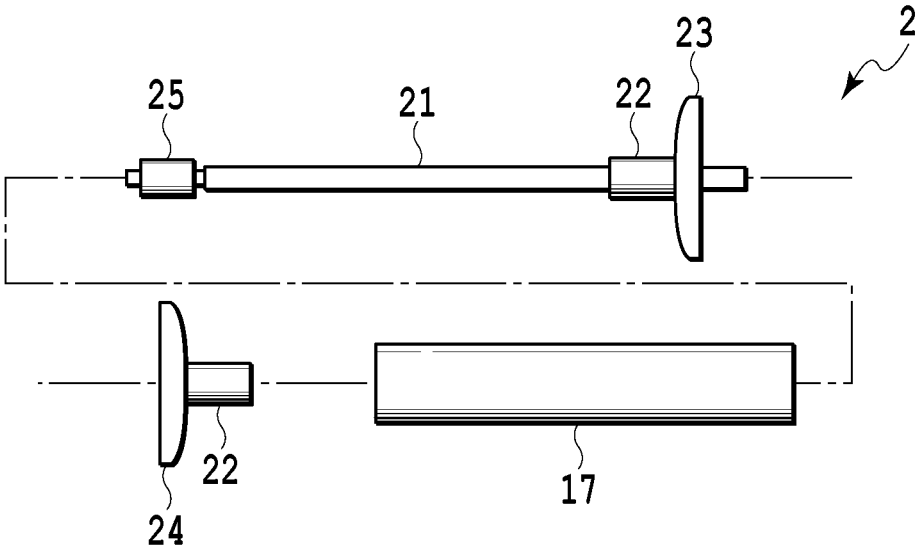
FIGS. 10A and 10B are views showing the spool member in the second usage form.
Figure 10B:
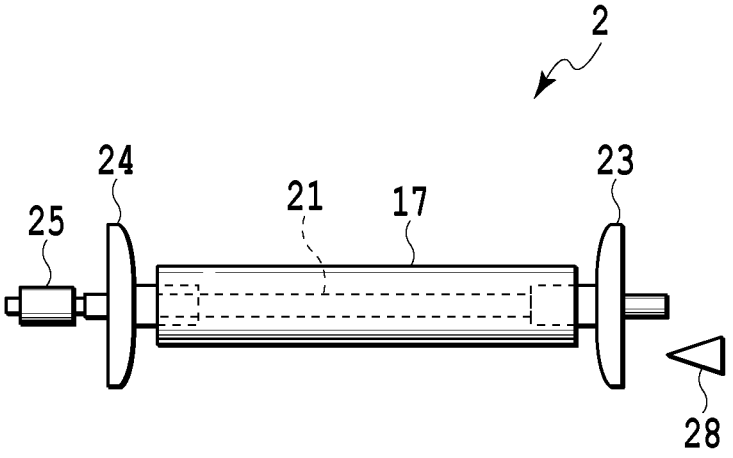

FIG. 10A is a front view of the spool member 2 in a disassembled state. FIG. 10B is a front view of the spool member 2 in an assembled state. A difference between the configuration of the spool member 2 in supplying as described with reference to FIGS. 3A to 3C and the configuration of the spool member 2 for winding is that the supply flange attachment 26 is not provided in the configuration of the spool member 2 for winding. That is, as described above, since the supply flange attachment 26 can be detached from the reference spool flange 23 and the non-reference spool flange 24, the supply flange attachment 26 is detached in the case of the purpose of winding.

Figure 11A:
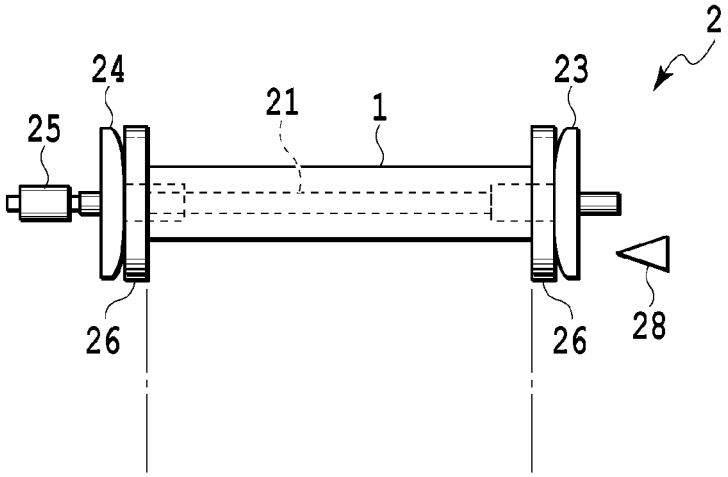
FIG. 11A is a front view of the spool member in the first usage form.
Figure 11B:
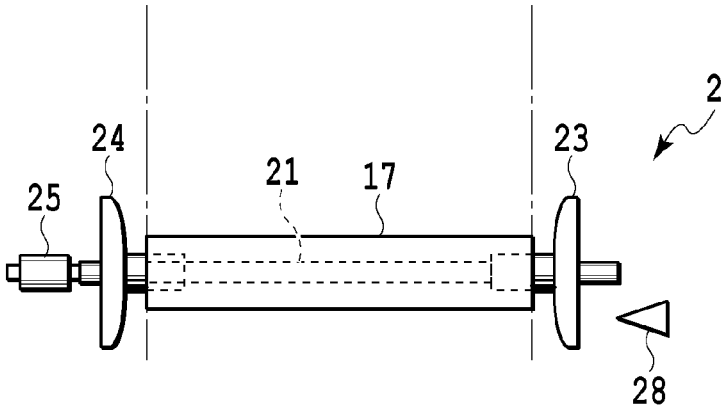
FIG. 11B is a front view of the spool member in the second usage form.

In FIGS. 11A and 11B, the spool member 2 in supplying and the spool member 2 in winding are arranged in a vertical direction and compared.

As shown in FIG. 11A, the supply flange attachment 26 is attached to the flange in supplying. An end surface of the supply flange attachment 26 is a flat surface and is caused to abut on the end portion of the roll sheet 1 to be set so as to position the roll sheet 1 in the width direction. A side of the non-reference spool flange 24 does not always need to be a flat surface, and the spool member 2 may be used with the supply flange attachment 26 detached.

On the other hand, as shown in FIG. 11B, end surfaces of the flanges in winding, that is, end surfaces of the reference spool flange 23 and the non-reference spool flange 24, are arranged with a distance that is greater than the width of the sheet 1, and are tapered. Therefore, skew of the sheet 1 that is wound around the paper core 17 can be allowed to some extent. It should be noted that the configuration other than this point is the same as the configuration in supplying which is described with reference to FIG. 3.

(Operation Flow in Paper Core Setting)

Figure 12:
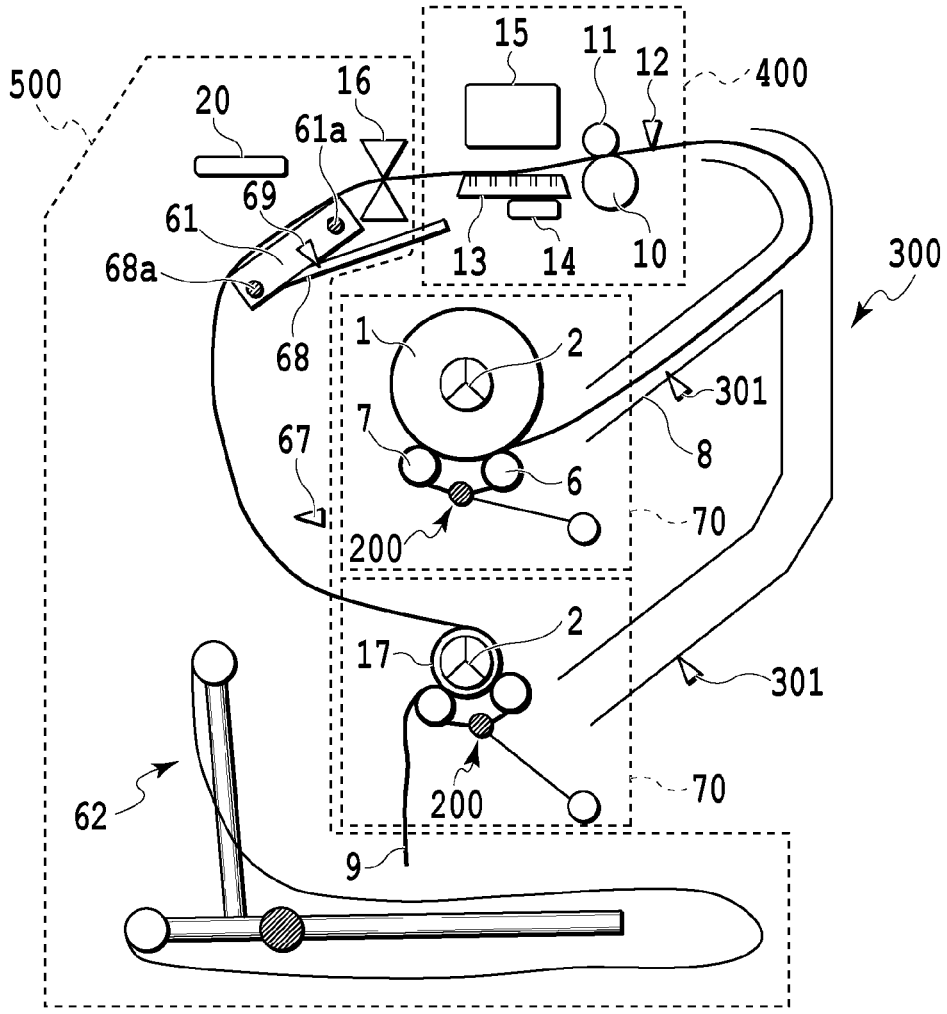
FIG. 12 is a view showing a configuration of the printing apparatus in the second usage form.
Figure 13:
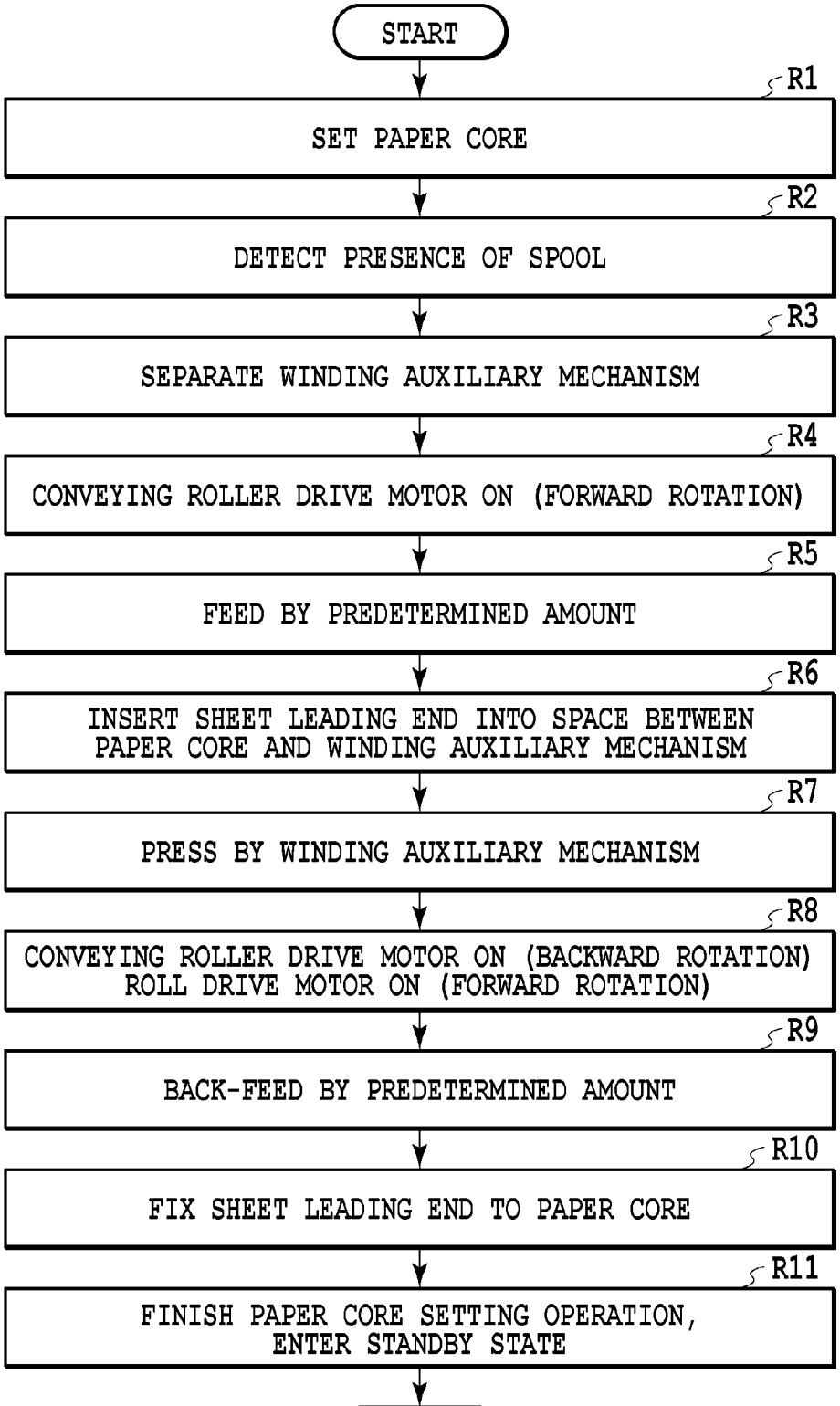
FIG. 13 is a flow showing an operation sequence in paper core attachment in the second usage form.

With reference to FIGS. 12 and 13, a description will be given of the operation of attaching the leading end 9 of the sheet 1 to the paper core 17 for sheet winding. FIG. 12 is a schematic view of the printing apparatus in the second usage form. FIG. 13 is a flow of an operation sequence when the paper core for sheet winding is set on the printing apparatus. In the following description, signs in parentheses indicate numbers of steps in the flow shown in the figure. A description will be given of the flow starting from the standby state after the sheet 1 is supplied from the upper supply unit 70 in accordance with step S1 through step S13 in the flow described with reference to FIG. 5.

The spool member 2 is inserted into the paper core 17 and set on the lower conveying unit 70 (R1). The spool presence/absence detection sensor 32 provided for the spool holder 31 detects the spool member 2 (R2). The pressure drive motor 33 is driven in the backward direction and the winding auxiliary mechanism 200 is separated from the spool member 2 (R3). Then, the printing apparatus performs the conveying operation of the sheet 1 supplied from the roll sheet 1 of the upper conveying unit 70. The conveying roller drive motor 35 is driven in the forward rotation direction (R4), and the sheet 1 is fed by the conveying roller 10 by a predetermined amount to reach near the paper core 17 attached to the lower conveying unit 70 (R5). Then, with a user operation, the leading end 9 of the sheet 1 is inserted into the space between the paper core and the winding auxiliary mechanism 200 that is separated from the paper core 17 (R6).

After that, if a trigger is generated by the operation on the operation panel 20 by the user, the pressure drive motor 33 of the lower conveying unit 70 is driven in the forward direction, and the winding auxiliary mechanism 200 presses the leading end 9 of the sheet 1 against the paper core 17 (R7). In this state, the conveying roller drive motor 35 is driven in the backward rotation direction, and at the same time, the roll drive motor 34 of the lower conveying unit 70 is driven in the forward rotation direction (R8).

That is, at this time, the two motors, namely, the conveying roller drive motor 35 and the roll drive motor 34 of the lower conveying unit 70, rotate in opposite directions. Since a friction force generated between the conveying roller 10 and the sheet 1 is set sufficiently greater than a friction force generated between the paper core 17 and the sheet 1, the sheet 1 is back-fed by a predetermined amount along with the backward rotation of the conveying roller 10 (R9).

The reason why the lower roll drive motor 34 is driven in the forward rotation direction is that a tension is applied to the sheet 1 by feed rotation of the paper core 17 with respect to the back-feeding operation by the conveying roller 10. By back-feeding the sheet 1 while the tension is applied, a warp of the sheet 1 to be wound around the paper core 17 is removed, and skew is corrected.

Then, in this state, the leading end 9 of the sheet 1 is fixed to the paper core 17 by using a tape or the like (R10).

By the way, a conventional winding apparatus does not have a mechanism like the winding auxiliary mechanism 200 of the present embodiment. Accordingly, in a case where the user fixes the leading end 9 of the sheet 1 to the paper core 17, the user himself/herself needs to apply a tension to the sheet by hand and carefully fix the sheet 1 straight by his/her own sense. That is, in the present embodiment, the winding auxiliary mechanism 200 mitigates the inconveniences of the conventional operation flow and contributes to the reduction of the load on the user.

As described above, the operation of attaching the leading end 9 of the sheet 1 to the paper core 17 for sheet winding (paper core setting operation) is completed, and the printing apparatus enters a standby state (R11).

(Operation Sequence in Printing in the Second Usage Form)

Figure 14:
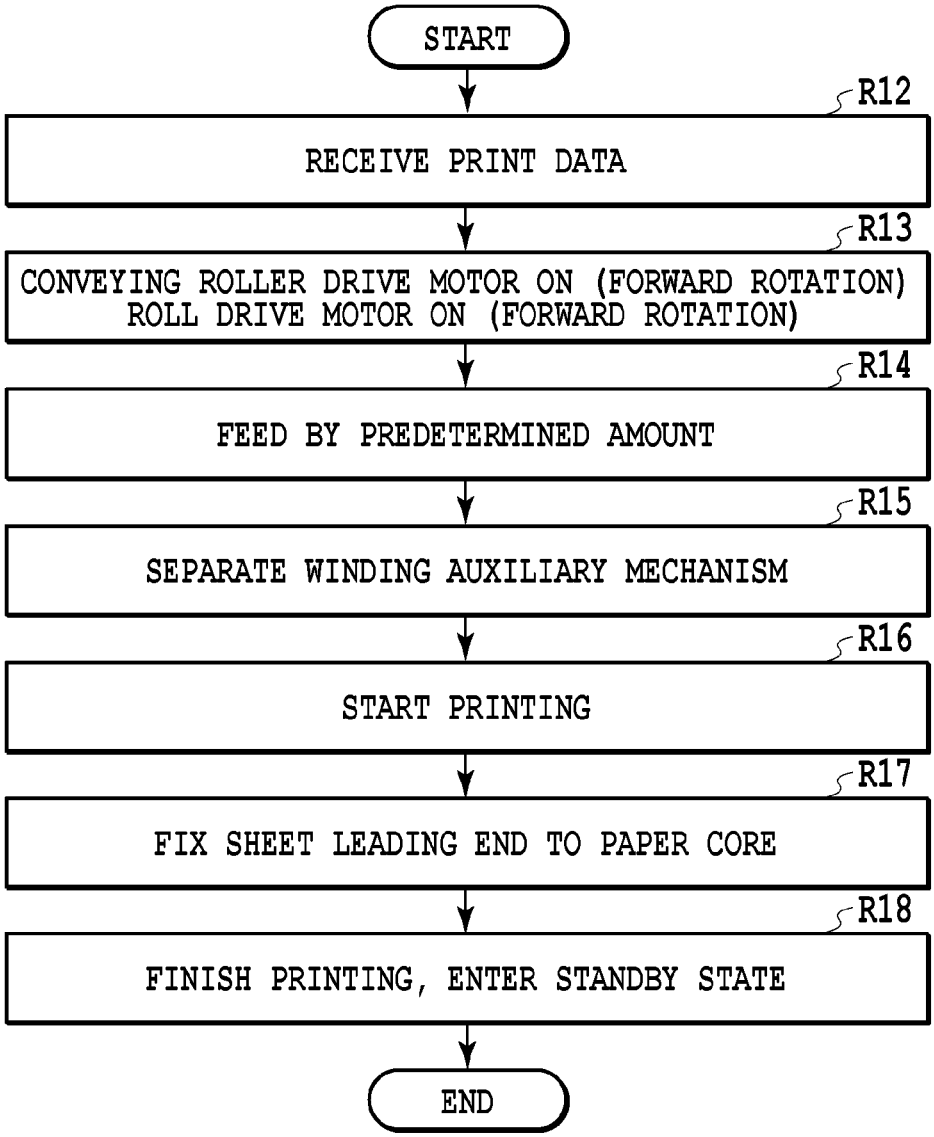
FIG. 14 is a flow showing an operation sequence in printing in the second usage form.

With reference to FIG. 14, a description will be given of a flow of an operation sequence in printing in the second usage form according to the first embodiment, that is, when winding is performed while printing. In the following description, signs in parentheses indicate numbers of steps in the flow shown in the figure.

If print data is received from a PC or the like (R12), both the conveying roller drive motor 35 and the roll drive motor 34 of the lower conveying unit 70 are driven in the forward rotation direction (R13), and conveyance of the sheet 1 is started. A print start position of the sheet 1 located on the standby position is fed to the position immediately below the print head 15 (R14). Then, the pressure drive motor 33 of the lower conveying unit 70 is driven in the backward direction, and the winding auxiliary mechanism 200 is separated (R15). Then, the print head 15 scans the sheet in the width direction and ejects ink to perform printing (R16).

With respect to the printing, the operation of the print head 15, the operation of the conveying roller 10, and the back tension applying operation of the roll drive motor 34 of the upper conveying unit 70 which supplies the sheet 1 are performed as described in step S17 of FIG. 6.

With respect to winding, the roll drive motor 34 of the lower conveying unit 70 for winding the sheet 1 that has passed the printing unit operates with the conveying roller 10. If the leading end of the printed sheet 1 is conveyed to the position of the lower conveying unit 70, the user stops the operation of the lower roll drive motor 34 by a pause button (not shown) or the like. At that time, the printing operation is continued without being stopped. In a state in which the winding operation is stopped, the user fixes the leading end of the sheet 1 to the paper core (R17), and after the paper core setting operation is finished, the user restarts the winding operation of the lower roll drive motor 34 by pressing the pause button again. At this time, the roll drive motor 34 is controlled by current restriction so as not to pull the sheet 1 with a predetermined torque (tension) or greater. This is because if a tension more than necessary is generated, conveyance precision is affected. This control achieves stable conveyance.

After printing is finished, in a case where winding is used following the printing, the printing apparatus enters the standby state accordingly (R18).

(Operation Sequence of Sheet End Processing)

Figure 15:
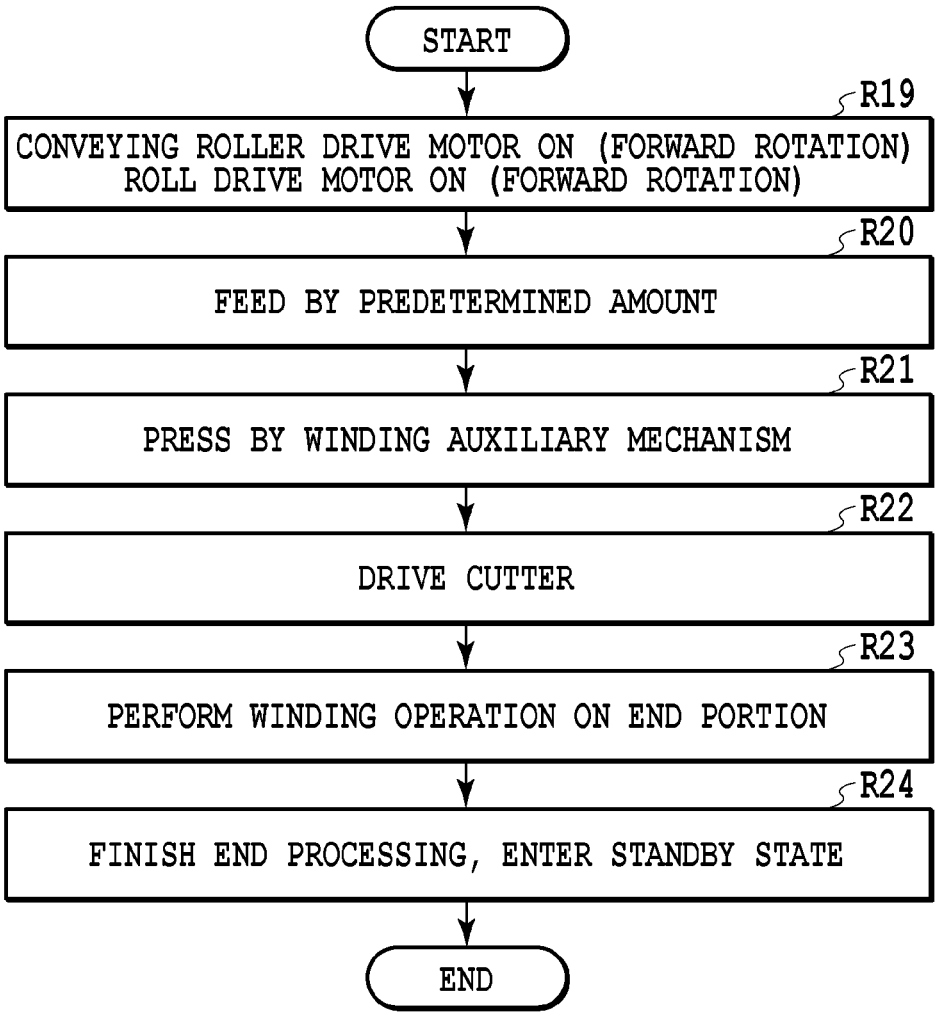
FIG. 15 is a flow showing an operation sequence in end processing in the second usage form.

With reference to FIG. 15, a description will be given of a flow of an operation sequence of sheet end processing in winding according to the first embodiment. In the following description, signs in parentheses indicate numbers of steps in the flow shown in the figure.

If a trigger of the end processing is generated by the operation on the operation panel 20 by the user, the conveying roller drive motor 35 and the roll drive motor 34 of the lower conveying unit 70 are driven in the forward rotation direction (R19), and feeding by a predetermined amount is performed (R20). Then, the pressure drive motor 33 of the lower conveying unit 70 is driven in the forward direction, and the winding auxiliary mechanism 200 is pressed against the surface of the sheet (roll sheet) 1 that is wound in a roll (R21).

At this time, if the rollers 6 and 7 of the winding auxiliary mechanism 200 come into contact with a printed portion, there is a possibility of ink transfer or the like. Therefore, in the feeding operation performed in step R20, it is preferable to wind and convey the sheet 1 until the printed portion comes to the downstream side at which the printed portion does not come into contact with the rollers 6 and 7. Alternatively, if the printed portion comes into contact with the rollers 6 and 7, a technique may be used to press the sheet 1 after a sufficient drying time or to apply fluorine coating or the like to the surfaces of the rollers to avoid transfer.

In either case, the cutter 16 is activated by the cutter drive motor (not shown) to cut the sheet 1 in the state in which the winding auxiliary mechanism 200 is pressed against the surface of the sheet (roll sheet) 1 wound in a roll (R22). It should be noted that generally, in cutting, the user holds by hand the trailing end of the sheet (roll sheet) 1 which is wound up by the conveying unit 70 acting as a winding unit so as to prevent the trailing end of the sheet from dropping from the roll portion of the roll sheet after the cutting.

After that, with the operation of the operation panel 20 or a button or the like by the user, the trailing end portion of the sheet 1 on the winding unit is wound up (R23). The trailing end of the sheet 1 is fixed to the roll portion of the wound roll sheet 1 by using a tape or the like, and the end processing is finished (R24).

As described above, in the first embodiment, in step R21 and the subsequent steps, the winding auxiliary mechanism 200 presses the surface of the roll sheet 1. Accordingly, during the operations from step R22 to step R24, there is no possibility that the wound roll sheet 1 is loosened even if there is a sag between the trailing end portion of the sheet 1 held by the user's hand and a portion pressed by the winding auxiliary mechanism 200.

The conventional winding unit does not have a mechanism like the winding auxiliary mechanism 200. Therefore, unless the wound roll sheet 1 is held carefully not to produce a sag after cutting, there is a possibility that the wound roll sheet 1 is loosened. Once the wound roll sheet 1 is loosened, then, the printed surface may be scratched to have an abrasion when wound up tight. That is, in the first embodiment, the inconveniences of the conventional operation sequence are reduced by the winding auxiliary mechanism 200, and at the same time, the winding auxiliary mechanism 200 contributes to improvement of the print quality.

According to the configuration described above, it is possible to provide the printing apparatus having the sheet winding function in which a load on the user is reduced.

In the above-described first embodiment, the supply auxiliary mechanism 200 and the winding auxiliary mechanism 200 automatically perform the separation operation and the contact operation. Meanwhile, in a second embodiment, a supply auxiliary mechanism 200 and a winding auxiliary mechanism 200 do not perform a separation operation, but maintain a contact state with respect to the outer periphery of a roll sheet 1 (or a paper core 17). A description will be given of a flow of an operation sequence according to the second embodiment. It should be noted that a description of the configuration and the operation that are the same as those of the above-described first embodiment will be omitted.

(First Usage Form)

First, a description will be given of a case where both of upper and lower conveying units 70 are used as supply units in the second embodiment (a first usage form according to the second embodiment).

(Operation Sequence in Sheet Supply According to the Second Embodiment)

Figure 17:
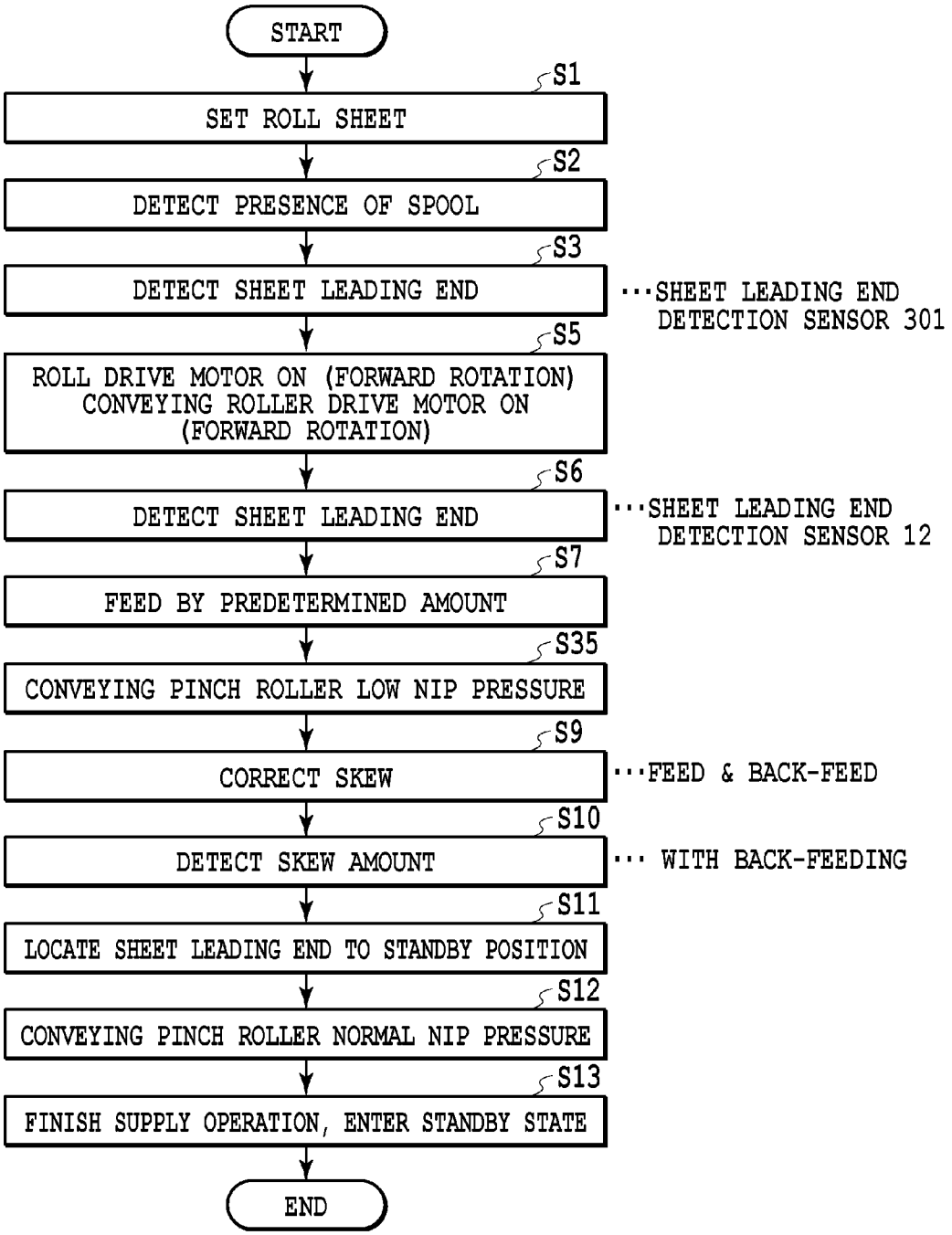
FIG. 17 is a flow showing an operation sequence in supplying in a first usage form according to a second embodiment.

FIG. 17 shows an example of a flow of an operation sequence in sheet supply according to the second embodiment. A description will be given of a difference from the flow in the first embodiment shown in FIG. 5. The same signs in FIGS. 5 and 17 indicate the same steps, so a description thereof will be omitted.

In the second embodiment, a series of the steps (S1 to S3) for setting a sheet by a user is the same as the one of the first embodiment described in FIG. 5.

In the first embodiment, next, the auxiliary mechanism 200 is rotated by the pressure drive motor 33 to press the roll sheet 1 (S4). Meanwhile, the second embodiment does not include a step corresponding to step S4. More specifically, in the first embodiment, the supply auxiliary mechanism 200 and the roll sheet 1 come into contact with each other when the roll sheet 1 is set on the conveying unit 70 in step S1, whereas in the second embodiment, this contact state is maintained in step S1 and the subsequent steps.

It should be noted that the essence of the present embodiment is that in a series of steps, the supply auxiliary mechanism 200 and the roll sheet 1 are not separated from each other. This can prevent loosening of the winding of the roll and reduce a load on the user. Accordingly, in the second embodiment, while the contact state is maintained, it is possible to arbitrarily change a pressing force against the roll sheet by rotating the auxiliary mechanism 200 by a pressure drive motor 33 according to the situation.

A series of the steps from starting sheet conveyance (S5) by a roll drive motor 34 and a conveying roller drive motor 35 to sheet leading end detection (S6) and sheet delivery (S7) in the second embodiment is the same as the one in the first embodiment described in FIG. 5.

In the first embodiment, after the sheet delivery (S7), the supply auxiliary mechanism 200 pressing the roll sheet 1 is released by separation before the nip pressure of the conveying pinch roller 11 with respect to the conveying roller 10 is set to a low nip pressure which is lower than a normal nip pressure used in printing (S8). Meanwhile, in the second embodiment, without releasing the pressing by separating the supply auxiliary mechanism 200 from the sheet 1, a nip pressure is set to a low nip pressure (S35). That is, as described above, in the second embodiment, the contact state between the supply auxiliary mechanism 200 and the roll sheet 1 is maintained.

A series of the subsequent steps, from skew correction (S9), skew amount detection (S10), stopping on the standby position (S11), changing a nip pressure to a normal nip pressure (S12), to end of the supply operation (S13), is the same as the one in the first embodiment described in FIG. 5.

(Operation Sequence in Printing in the First Usage Form According to the Second Embodiment)

The flow of the first embodiment shown in FIG. 6 by itself can be applied to a flow of an operation sequence in printing in the first usage form according to the second embodiment. Also in the second embodiment, like the first embodiment, since the operation sequence in printing is started from the above-described state (step S13) in which the operation in supplying is finished, a nip pressure of the conveying pinch roller 11 with respect to the conveying roller 10 at the time of starting the operation is a normal nip pressure. Meanwhile, unlike the first embodiment, since the second embodiment does not include a step of releasing the pressing of the roll sheet 1 by the supply auxiliary mechanism 200, the printing operation is performed in the pressing state.

(Operation Sequence in Sheet Winding-Back According to the Second Embodiment)

Figure 18:
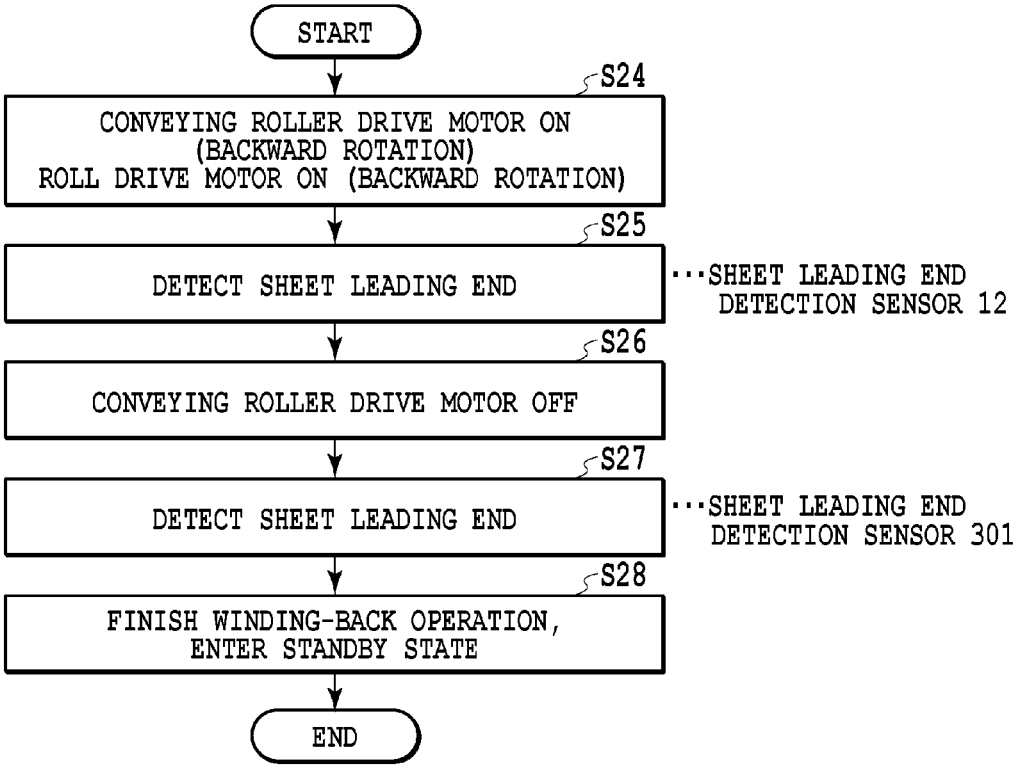
FIG. 18 is a flow showing a winding-back operation sequence in the first usage form.

FIG. 18 is a flow of an operation sequence of winding back the leading end 9 of the sheet 1 according to the second embodiment. A description will be given of a difference from the flow in the first embodiment shown in FIG. 7. The same signs in FIGS. 7 and 18 indicate the same steps, so a description thereof will be omitted.

In the first embodiment shown in FIG. 7, to start a winding-back operation, first, the auxiliary mechanism 200 is pressed against the roll sheet 1 (S23). This is performed to avoid loosening of the winding of the roll sheet 1 on the conveying unit 70 as a supply unit.

Meanwhile, the flow in the second embodiment shown in FIG. 18 does not include a step corresponding to step S23. As described above, this is because in the second embodiment, the printing operation is performed in the state in which the supply auxiliary mechanism 200 presses the roll sheet 1, without involving the releasing operation, and the pressing state is maintained at the time of start of the winding-back. Therefore, also in the second embodiment, in performing the winding-back operation, loosening of the winding of the roll sheet 1 on the conveying unit 70 as a supply unit is avoided.

The subsequent steps (S24 to S28) in the second embodiment are the same as those of the first embodiment described in FIG. 7.

A description has been given of the first usage form according to the second embodiment in which both of the upper and lower conveying units 70 are used as supply units. Next, a description will be given of the case of a second usage form in which one of the conveying units 70 is used as a winding unit.

(Second Usage Form)

Next, a description will be given of the case of using the upper conveying unit 70 as a supply unit and the lower conveying unit 70 as a winding unit in the second embodiment (a second usage form according to the second embodiment). It should be noted that a description of the configuration and the operation that are the same as those of the above-described first embodiment and the first usage form of the second embodiment will be omitted.

(Operation Flow in Paper Core Setting in the Second Usage Form According to the Second Embodiment)

Figure 19:
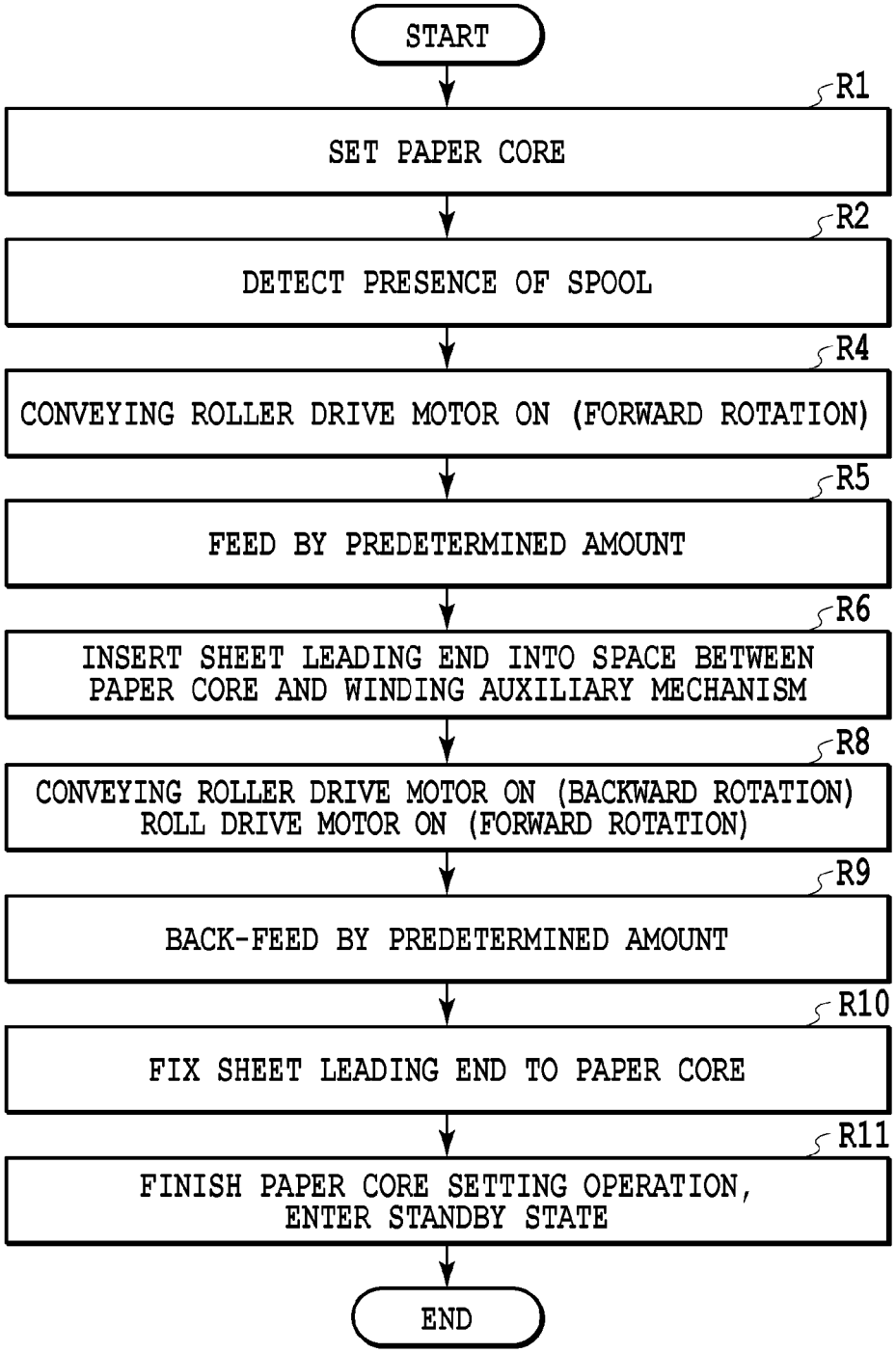
FIG. 19 is a flow showing an operation sequence in paper core attachment in a second usage form.

FIGS. 12 and 19 illustrate an operation of attaching the leading end 9 of the sheet 1 to the paper core 17 for sheet winding in the second usage form according to the second embodiment. FIG. 12 is a schematic view of a printing apparatus in the second usage form. FIG. 19 shows an operation flow when the paper core for sheet winding is set on the printing apparatus. The operation flow in paper core setting is started from the standby state after the sheet 1 is supplied from the upper supply unit 70 in accordance with step S1 through step S13 in the operation sequence in sheet supply shown in FIG. 17.

A description will be given of a difference between the flow in the second embodiment shown in FIG. 19 and the flow in the first embodiment shown in FIG. 13. The same signs in FIGS. 13 and 19 indicate the same steps, so a description thereof will be omitted.

A series of steps from paper core setting (R1) to spool detection (R2) in the second embodiment is the same as the one of the first embodiment described in FIG. 13.

After it is detected that there is a spool (R2), in the first embodiment, the winding auxiliary mechanism 200 is separated from the paper core 17 (R3). Meanwhile, the second embodiment does not include the separation step corresponding to step R3, and thus the contact state of the winding auxiliary mechanism 200 with respect to the paper core 17 is maintained in the second embodiment.

A series of the subsequent steps, from driving the conveying roller (R4), feeding the sheet by the predetermined amount (R5), to inserting the sheet leading end into the space between the paper core and the winding auxiliary mechanism (R6), is the same as the one in the first embodiment described in FIG. 13.

Next, in the first embodiment, the winding auxiliary mechanism 200 is pressed against the paper core (the sheet 1 eventually) (R7). Meanwhile, the second embodiment does not include the separation step corresponding to step R7. This is because since the contact state of the winding auxiliary mechanism 200 with respect to the paper core 17 is maintained in the second embodiment, there is no need to have a pressing operation again.

A series of steps, from driving the driving motors 34 and 35 (R8), back-feeding the sheet 1 by the predetermined amount (R9), fixing the leading end of the sheet to the paper core 17 (R10), completing the attachment operation, to entering the standby state (R11), is the same as the one in the first embodiment.

(Operation Sequence in Printing in the Second Usage Form According to the Second Embodiment)

Figure 20:
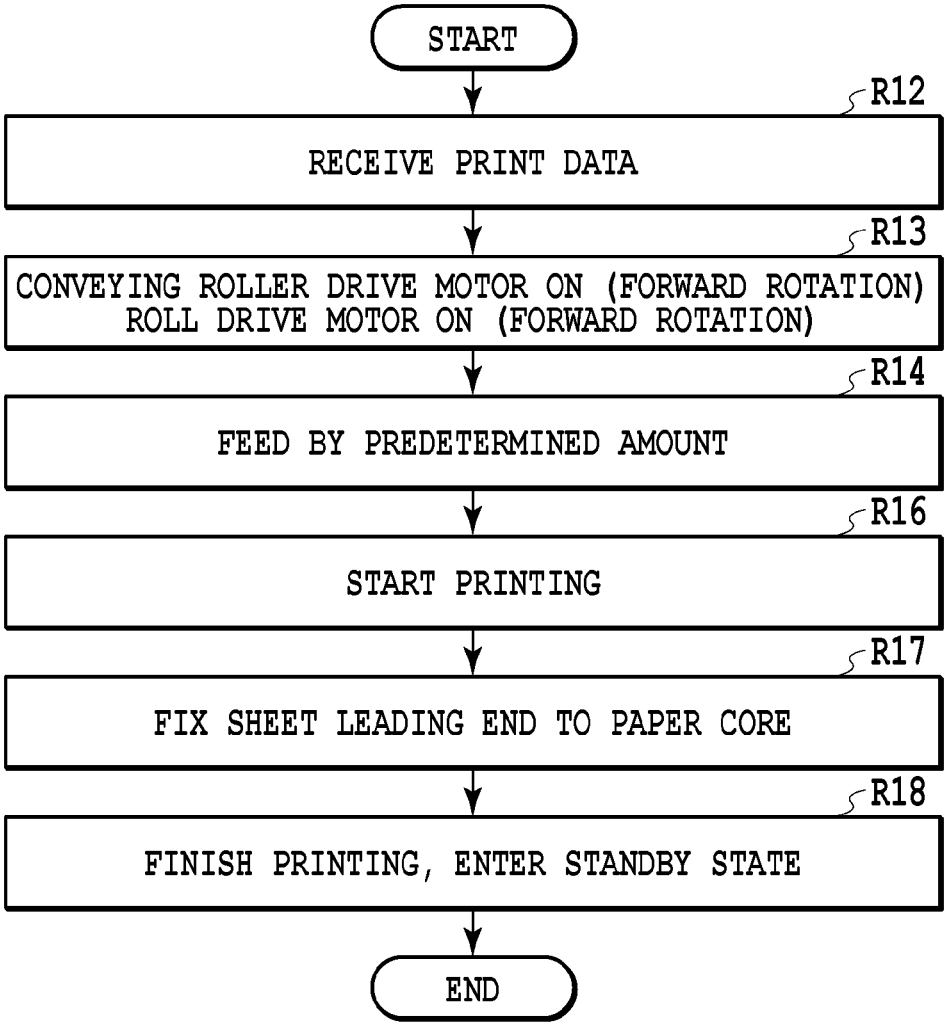
FIG. 20 is a flow showing an operation sequence in printing in the second usage form.

FIG. 20 shows an example of a flow of an operation sequence in the case of printing in the second usage form according to the second embodiment, that is, in the case of printing while winding. A description will be given of a difference from the flow in the first embodiment shown in FIG. 14. The same signs in FIGS. 14 and 20 indicate the same steps, so a description thereof will be omitted.

A series of steps from receiving print data (R12), driving the drive motors 34 and 35 (R13), to feeding the sheet 1 by the predetermined amount (R14) is the same as the one in the first embodiment described in FIG. 14.

After the sheet is fed by the predetermined amount (R14), in the first embodiment, the winding auxiliary mechanism 200 is separated from the paper core 17 (the sheet 1 eventually) (R15). Meanwhile, the second embodiment does not include the separation step corresponding to step R3. Thus, the contact state of the winding auxiliary mechanism 200 with respect to the paper core 17 (sheet 1) is maintained in the second embodiment.

A series of the subsequent steps, from printing (R16), fixing the sheet leading end to the paper core (R17), to finishing printing to entering the standby state (R17), is the same as the one in the first embodiment described in FIG. 14.

(Operation Sequence of Sheet End Processing in the Second Usage Form According to the Second Embodiment)

Figure 21:
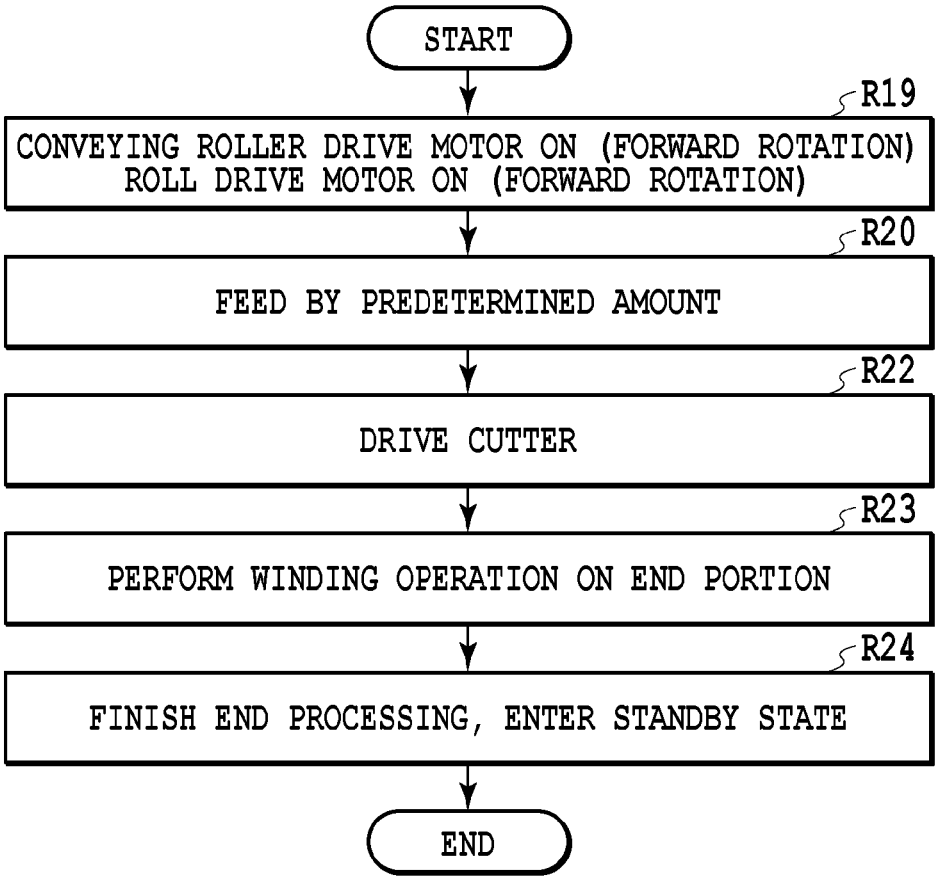
FIG. 21 is a flow showing an operation sequence in end processing in the second usage form.

FIG. 21 shows an example of a flow of an operation sequence of sheet end processing according to the second embodiment. A description will be given of a difference from the flow of the first embodiment shown in FIG. 15. The same signs in FIGS. 15 and 21 indicate the same steps, so a description thereof will be omitted.

A difference between the first embodiment and the second embodiment is whether to include the step of pressing the winding auxiliary mechanism 200 against the roll sheet 1 (R21) before the step of cutting the sheet 1 by activating the cutter 16 by the cutter drive motor (R22). The first embodiment shown in FIG. 15 includes the pressing step (R21), whereas the second embodiment shown in FIG. 21 does not include the pressing step (R21). This is because since the winding auxiliary mechanism 200 is consistently kept into contact with and pressed against the roll sheet 1 in and after the setting operation of the paper core 17, there is no need to perform the pressing step (R21) again.

As described above, in the present embodiment, the supply auxiliary mechanism 200 and the winding auxiliary mechanism 200 are not separated from the roll sheet 1 (or the outer periphery of the paper core 17), but the contact state is maintained. It is possible to perform their respective operations even in this state without problems.

According to the configuration described above, it is possible to provide the printing apparatus having the sheet winding function in which a load on the user is reduced.

In the above first embodiment, the supply auxiliary mechanism 200 and the winding auxiliary mechanism 200 automatically perform the separation operation and the contact operation. Meanwhile, in the above second embodiment, the supply auxiliary mechanism 200 and the winding auxiliary mechanism 200 maintain the contact state without being separated from the roll sheet 1 or the paper core 17. Meanwhile, in a third embodiment, a supply auxiliary mechanism 200 and a winding auxiliary mechanism 200 do not automatically perform a separation operation and a contact operation, but a user manually performs the separation operation and the contact operation. This will be described. A description of the configuration and the operation that are the same as those of the above-described first and second embodiments will be omitted.

(Second Usage Form According to a Third Embodiment)

Figure 22:
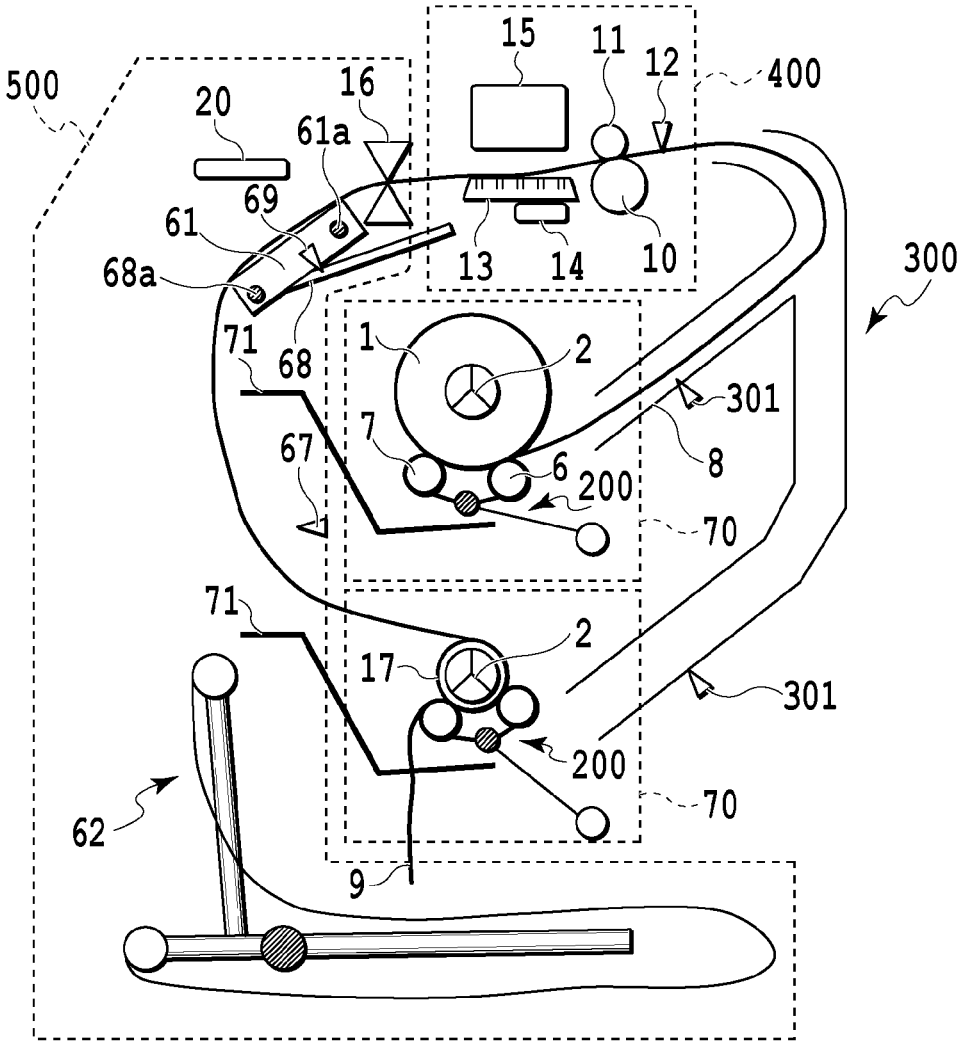
FIG. 22 is a view showing a configuration of a printing apparatus in a second usage form according to a third embodiment.

FIG. 22 is a view showing a configuration of a printing apparatus in a second usage form according to a third embodiment. In FIG. 22, a lever 71 is a lever with which a user can manually cause the supply auxiliary mechanism 200 and the winding auxiliary mechanism 200 to be separated from or to be in contact with (separation/contact) a roll sheet 1 or a paper core 17 for sheet winding from the outer periphery side thereof. Although not shown in the figure, there is a sensor that can detect a separation/contact state (e.g., a pressing force). If the printing apparatus body is ON, it is possible to know the states of the auxiliary mechanisms 200.

To have the user operate to change the separation/contact state of the auxiliary mechanism 200 (change in a pressing force), the operation of the printing apparatus body is paused, and a message is displayed on an operation panel 20 so that the user is prompted for an operation. If the user checks the display and changes the state of the lever 71, a sensor (not shown) detects the change in the state, and the printing apparatus body moves to the next operation.

According also to the configuration of the present embodiment, it is possible to provide the printing apparatus having the sheet winding function in which a load on the user is reduced.

As described above, in the first embodiment, a description has been given of the case of the operation sequences in which the supply auxiliary mechanism 200 and the winding auxiliary mechanism 200 automatically perform the separation operation and the contact operation. In the second embodiment, a description has been given of the operation sequences in which the supply auxiliary mechanism 200 and the winding auxiliary mechanism 200 do not perform the separation operation but maintain the contact state. In the present invention, there is no problem, in terms of functions, in keeping the supply auxiliary mechanism 200 and the winding auxiliary mechanism 200 in the contact state. Further, during the operations in supplying, printing, winding, setting a roll sheet or a paper core for winding, end processing, and the like, the separation/contact state may be changed automatically or manually as necessary. This operation is not limited.

In the present invention, any pressing force of the auxiliary mechanism 200 with respect to the roll sheet (a separation state or a contact state and a level of a pressing force in the contact state) may be set according to the situation.

For example, after a leading end of a sheet drawn from a roll sheet is threaded through a nip of a conveying roller in front of a printing unit, using a low pressing force in the supply unit that is lower than a pressing force for drawing the leading end of the sheet can preferably correct skew of the sheet.

Further, while printing is performed, using a relatively low pressing force in the supply unit and the winding unit can achieve stable conveyance without producing a tension more than necessary on the sheet, and damage to the roll sheet can be reduced. In addition, separating the auxiliary mechanism at the same time can protect the auxiliary mechanism from ink transfer or the like from the wound sheet.

When the sheet is cut, using a relatively large pressing force can prevent a warp of the sheet by releasing a tension by cutting and loosening of the winding of the roll sheet. Furthermore, using a relatively small pressing force in back-feeding to fix and attach the leading end of the sheet to the paper core for winding in the winding unit can preferably correct skew of the sheet.

The pressing force may be set in two levels (low and high). To obtain a preferable effect according to the situation, the pressing force may be set in three or more levels. Further, the pressing force of the supply auxiliary mechanism and the pressing force of the winding auxiliary mechanism may be set independently, and these pressing forces may be the same or different.

In the present embodiment, the printing apparatus has two conveying units, but the present invention may be applied also to a printing apparatus having three or more conveying units. Furthermore, the present invention is not limited to the printing apparatus, and can be applied generally to a winding apparatus for winding an article in the form of a sheet.

In the above first embodiment, the supply auxiliary mechanism 200 and the winding auxiliary mechanism 200 automatically perform the separation operation and the contact operation. In the above second embodiment, the supply auxiliary mechanism 200 and the winding auxiliary mechanism 200 maintain the contact state without being separated from the roll sheet 1 or the paper core 17. In the above third embodiment, the supply auxiliary mechanism 200 and the winding auxiliary mechanism 200 do not automatically perform the separation operation and the contact operation, but the user manually performs the separation operation and the contact operation.

In an operation sequence in printing according to a fourth embodiment, switching between separation and contact of an auxiliary mechanism 200 is performed automatically or manually according to at least one of a sheet type and a winding direction. A description will be given below.

For example, in the case of an inwardly wound roll sheet which has a high stiffness and is wound to have a printed surface inwardly, since the roll is highly stiff and is wound in a direction opposite to the curl of the roll, the normal winding results in loosening of the winding and an abrasion. To solve this problem, it is needed to wind up the sheet with a greatly increased tension for winding. However, if a sheet 1 is pulled with a predetermined tension or greater in winding, conveyance precision may be affected and stable conveyance may not be achieved. To avoid this, loosening of the winding can be prevented by bringing the auxiliary mechanism 200 into contact with the sheet 1 in winding and a rotation load can be reduced by forming a pressing portion as a rotor such as a roller. This allows winding without loosening and without increasing a tension in winding. This configuration can achieve normal winding without affecting the conveyance precision or increasing the cost of motors.

In the case of a sheet having a low stiffness, loosening of the winding does not occur since the curl of the sheet is small. There is also a case where bringing the auxiliary mechanism 200 into contact with the sheet may produce a trace due to pressure and contact by rollers. In this case, the auxiliary mechanism 200 is separated and used.

Further, in the case of an outwardly wound roll sheet which is wound to have a printed surface outwardly, since a curl direction of the sheet and a winding direction of the roll match, loosening of the winding is not likely to occur even without bringing the auxiliary mechanism 200 into contact with the sheet. Further, in the case of a sheet having a lower print drying performance, since the printed surface faces outwardly, an adverse effect such as transfer to the roller or the like may occur by bringing the auxiliary mechanism 200 into contact with the sheet. Also in this case, winding is performed by separating the auxiliary mechanism 200.

As described above, automatically or manually switching between the separation and the contact of the auxiliary mechanism 200 according to the conditions such as a sheet type and a winding direction can maintain conveyance precision and handle more sheets.

Regarding setting of the separation and the contact of the auxiliary mechanism 200, a predetermined value is set in advance for each sheet based on a curl property of a sheet, a transfer property of a print, and the like. In a case where the set value is different from a value intended by a user, the setting may be changed manually.

Figure 23:
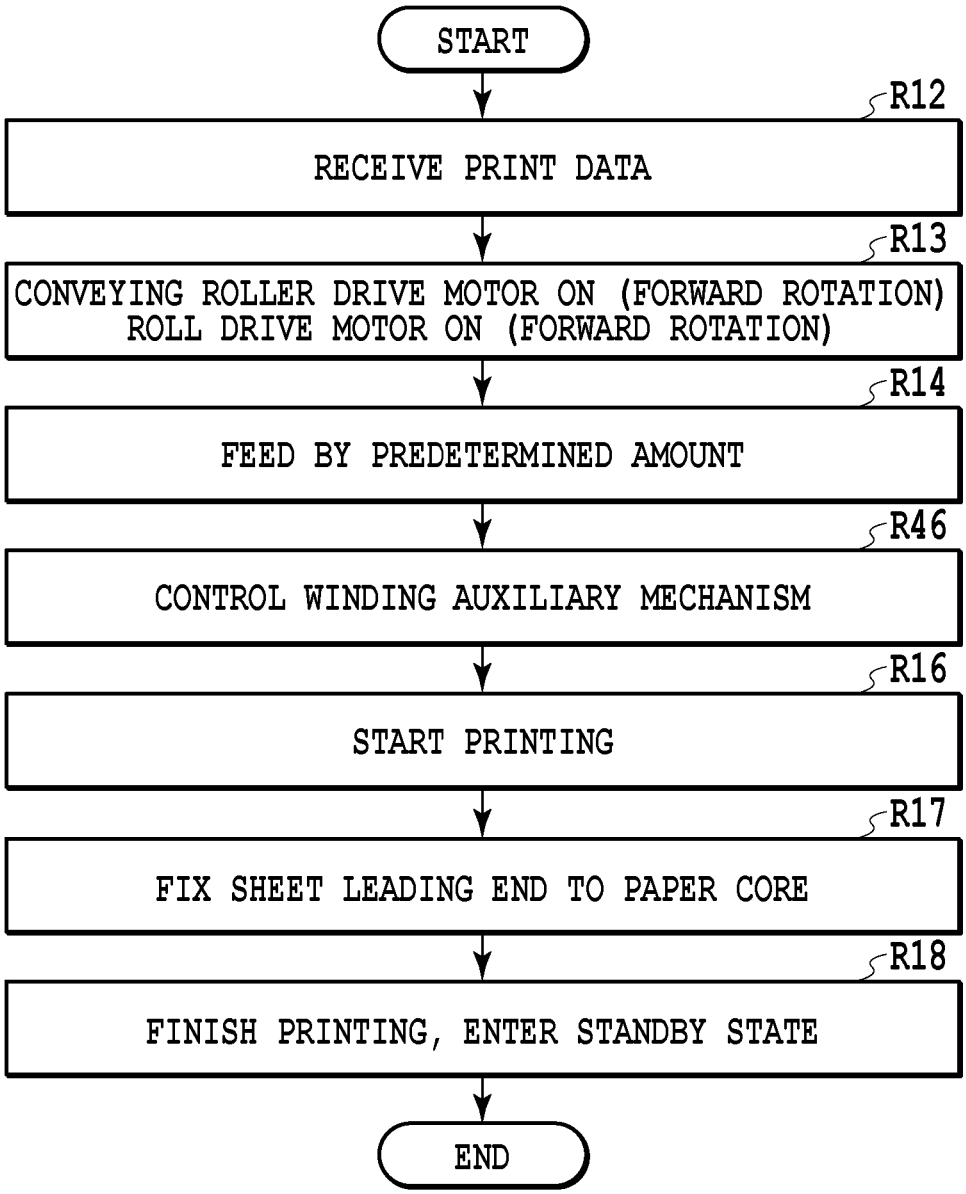
FIG. 23 is a flow showing an operation sequence in printing in a second usage form according to a fourth embodiment.

FIG. 23 shows a flow of an operation sequence in printing, that is, in printing while winding (second usage form) according to the fourth embodiment. In the following description, signs in parentheses indicate numbers of steps in the flow shown in the figure.

If print data is received from a PC or the like (R12), both the conveying roller drive motor 35 and the roll drive motor 34 of the lower conveying unit 70 are driven in the forward rotation direction (R13), and conveyance of the sheet 1 is started. The leading end 9 of the sheet 1 located on the standby position is fed to the position immediately below the print head 15 (R14). Then, a pressure drive motor 33 of the lower conveying unit 70 is driven in a direction set based at least on one of a sheet type and a winding direction, and the winding auxiliary mechanism 200 is separated from or is kept into contact with the roll sheet 1 (R46). Then, the print head 15 scans the sheet in the width direction and ejects ink to perform printing (R16).

Here, FIGS. 14, 20, and 23 are compared. In the first embodiment shown in FIG. 14, the operation of separating the auxiliary mechanism 200 (R15) is performed between step R14 and step R16. In the second embodiment shown in FIG. 20, the operation of separating the auxiliary mechanism 200 is not performed between step R14 and step R16, and the contact state is maintained. Meanwhile, in the fourth embodiment, as shown in FIG. 23, the separation state or the contact state of the auxiliary mechanism 200 is set or manually switched (R46). This allows preferable printing and sheet winding according to the condition.

In the above first embodiment, the supply auxiliary mechanism 200 and the winding auxiliary mechanism 200 automatically perform the separation operation and the contact operation. In the above second embodiment, the supply auxiliary mechanism 200 and the winding auxiliary mechanism 200 maintain the contact state without being separated from the roll sheet 1 or the paper core 17. In the above third embodiment, the supply auxiliary mechanism 200 and the winding auxiliary mechanism 200 do not automatically perform the separation operation and the contact operation, but the user manually performs the separation operation and the contact operation. In the above fourth embodiment, in the operation sequence in printing, switching between separation and contact of the auxiliary mechanism 200 is performed automatically or manually according to at least one of a sheet type and a winding direction. In a fifth embodiment, when driving of a roll drive motor 34 in winding is stopped, switching between separation and contact of an auxiliary mechanism 200 with respect to a roll sheet 1 is performed. A description will be given below.

For example, in a winding apparatus for winding a roll sheet by driving the roll drive motor 34 like this case, unless the drive motor 34 is energized, a spool shaft 2 becomes freely rotated, causing loosening of the winding of the roll sheet and an abrasion. In order to avoid loosening of the winding of the roll sheet, after the apparatus body is turned ON, it is needed to have the roll drive motor 34 always energized even in print standby. However, having the roll drive motor 34 always energized increases a power consumption of the motor and the temperature of the motor rises. In general, therefore, the energization of the roll drive motor 34 is cut. Also when the apparatus body is turned OFF, the energization of the roll drive motor 34 is cut. This causes loosening of the winding. Therefore, in such a winding apparatus, after the apparatus body is turned ON, also in print standby or in the situation of turning OFF the apparatus body, it is needed to avoid loosening of the winding of the roll sheet. Then, in the fifth embodiment, before the energization of the roll drive motor 34 is cut, that is, before the roll drive motor 34 becomes undriven, loosening of the winding is prevented by automatically bringing a winding auxiliary mechanism 200 into contact with the roll sheet, so that degradation of a winding quality can be minimized.

Figure 24:
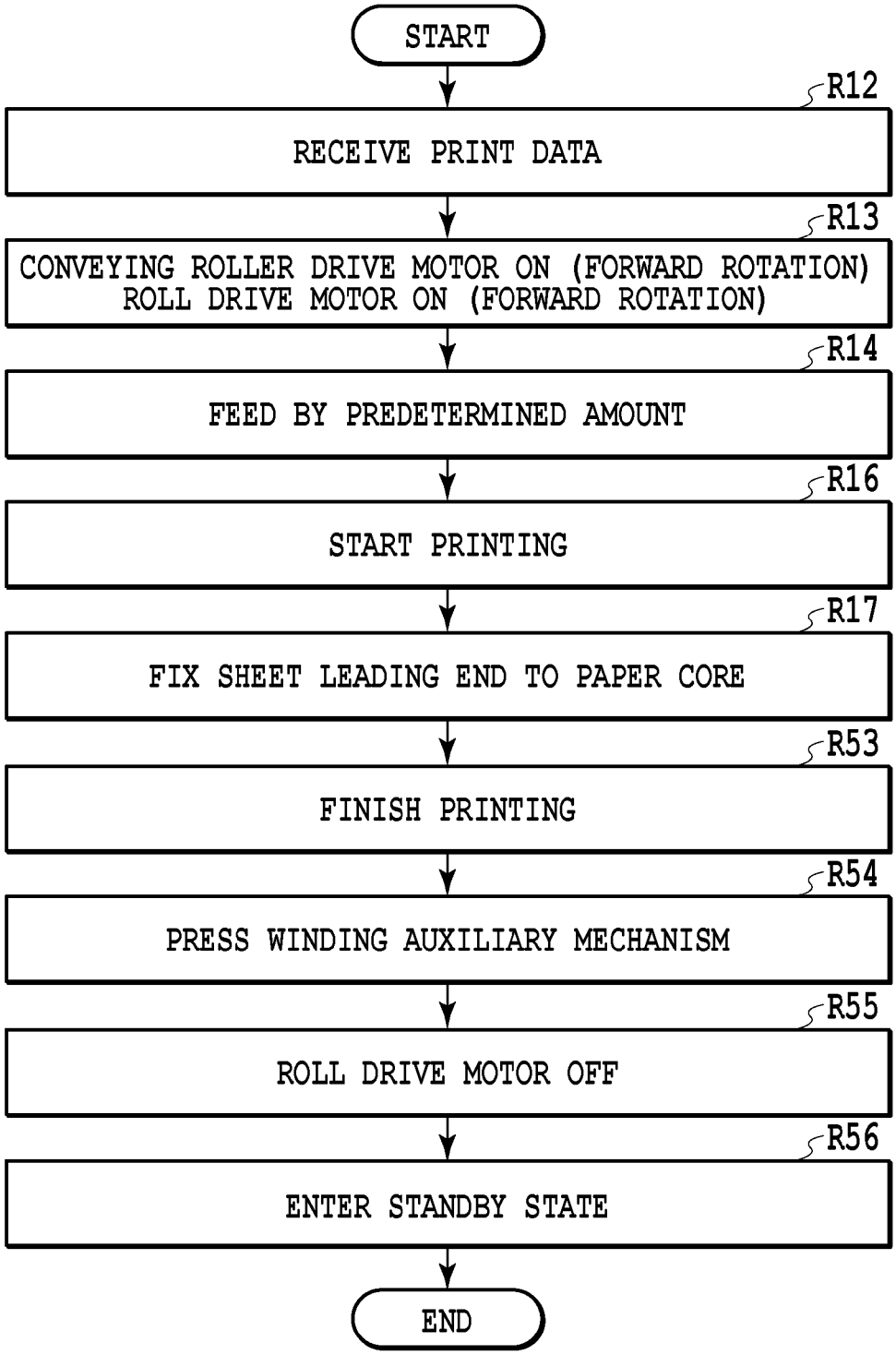
FIG. 24 is a flow showing an operation sequence while a drive motor is OFF in a second usage form according to a fifth embodiment.

FIG. 24 shows a flow of an operation sequence in printing, that is, in printing while winding (second usage form) according to the fifth embodiment. In the following description, signs in parentheses indicate numbers of steps in the flow shown in the figure.

If print data is received from a PC or the like (R12), both the conveying roller drive motor 35 and the roll drive motor 34 of the lower conveying unit 70 are driven in the forward rotation direction (R13), and conveyance of the sheet 1 is started. The leading end 9 of the sheet 1 located on the standby position is fed to the position immediately below the print head 15 (R14). Then, the print head 15 scans the sheet in the width direction and ejects ink to perform printing (R16). If the sheet 1 reaches the paper core 17, the leading end 9 of the sheet 1 is fixed to the paper core 17 (R17). After printing is finished (R53), the pressure drive motor 33 of the lower conveying unit 70 keeps the winding auxiliary mechanism 200 into contact with the wound sheet 1 (R54). Then, driving of the roll drive motor 34 is stopped (undriven) (R54), and the printer enters a standby state (R55).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2014-234757, filed Nov. 19, 2014, and No. 2015-171424, filed Aug. 31, 2015, which are hereby incorporated by reference wherein in their entirety.

What is claimed is:

1. A printing apparatus comprising:

a printing unit having a print head configured to perform printing on a sheet that is continuous;

a cutter unit configured to cut the sheet;

a basket unit configured to receive a sheet on which an image is printed by the printing unit and which is cut by the cutter unit;

a first driving unit configured to apply a rotational force to a first spool that holds a rolled sheet;

a second driving unit configured to apply a rotational force to a second spool that holds a rolled sheet;

a first pressing roller configured to apply a pressing force to an outer peripheral surface of the rolled sheet held by the first spool;

a second pressing roller configured to apply a pressing force to an outer peripheral surface of the rolled sheet held by the second spool; and a control unit configured to control the printing apparatus, wherein the printing apparatus is configured to operate in (a) a first mode in which the first driving unit drives the first spool to feed out the rolled sheet on the first spool to the printing unit, the printing unit performs printing on the fed sheet, the cutter unit cuts the fed sheet and the basket unit receives the printed and cut sheet, and (b) a second mode in which the second driving unit drives the second spool to feed out the rolled sheet on the second spool to the printing unit, the printing unit performs printing on the fed sheet, the cutter unit cuts the fed sheet and the basket unit receives the printed and cut sheet, and wherein the control unit controls the printing apparatus such that, in the first mode and the second mode, during a sheet feeding operation in which a leading edge of the sheet is fed toward a printing position of the print head, one of the first and second pressing rollers presses the outer peripheral surface with a first pressing force, during a printing operation in which an image is printed on the fed sheet by the print head, the one of the first and second pressing rollers presses the outer peripheral surface with a second pressing force that is smaller than the first pressing force, and when the cutter unit cuts the sheet, the one of the first and second pressing rollers presses the outer peripheral surface with a third pressing force that is larger than the second pressing force.

2. The printing apparatus according to claim 1, wherein each of the first and the second rollers contacts the rolled sheet from a lower side in a vertical direction.

3. The printing apparatus according to claim 1, wherein, with respect to a vertical direction, the first driving unit is provided above the second driving unit, the printing unit is provided above the first driving unit, and the basket unit is disposed at the side of the second driving unit.

4. The printing apparatus according to claim 1, wherein the printing apparatus is further configured to operate in (c) a third mode in which the first driving unit drives the first spool to feed out the rolled sheet on the first spool to the printing unit, the printing unit performs printing on the fed sheet, and the second driving unit drives the second spool to wind up the printed sheet as a roll.

5. The printing apparatus according to claim 4, wherein in the third mode, the pressing roller is apart from the outer peripheral surface of the roll of the printed sheet.

6. The printing apparatus according to claim 5, wherein the second driving unit performs (a) in the second mode, a feeding rotation of the second spool in a first rotational direction to feed out the sheet from the second spool, and (b) in the third mode, a winding rotation of the second spool in the first rotational direction or a second rotational direction, which is opposite to the first rotational direction, to wind up the printed sheet around the second spool.

7. A printing apparatus comprising:

a mount unit configured to mount a roll sheet obtained by winding a continuous sheet into a roll shape;

a driving unit configured to rotate the roll sheet mounted on the mount unit;

a pressing member configured to press a surface of the roll sheet mounted on the mount unit;

a printing unit configured to perform printing on the roll sheet supplied from the mount unit;

a cutter unit configured to cut the roll sheet on which printing is performed by the printing unit; and a control unit which controls the printing apparatus, wherein the control unit controls the pressing force of the pressing member such that, when the roll sheet is fed from the mount unit toward the printing unit, the pressing member presses a surface of the roll sheet at a first pressing force, when printing is performed on a roll sheet by the printing unit, the pressing member employs a second pressing force that is smaller than the first pressing force to press a surface of the roll sheet, and when cutting of the roll sheet is performed by the cutter unit, the pressing member presses a surface of the roll sheet at a third pressing force that is larger than the second pressing force.

8. The printing apparatus according to claim 7, wherein the control unit controls the pressing force of the pressing member such that when printing is performed on the roll sheet by the printing unit, the pressing member is apart from a surface of the roll sheet.

9. The printing apparatus according to claim 8, wherein the control unit controls the pressing force of the pressing member such that when driving of the driving unit is to be stopped, the pressing member is brought into contact with a surface of the roll sheet prior to stopping of driving.

10. The printing apparatus according to claim 7, wherein the control unit operates in a mode of operation in which the roll sheet is wound back from the printing unit to the mount unit.

11. The printing apparatus according to claim 10, wherein the control unit controls the pressing force of the pressing member such that when the roll sheet is wound back from the printing unit to the mount unit, the pressing member presses a surface of the roll sheet at a fourth pressing force that is equal to or larger than the second pressing force.

12. The printing apparatus according to claim 7, wherein the pressing member is configured to apply a pressing force from a lower side of the roll sheet in a vertical direction.

13. The printing apparatus according to claim 7, wherein the pressing member is configured to be separable from the surface of the roll sheet when a pressing force employed for the pressing member is zero.

14. The printing apparatus according to claim 7, wherein the printing apparatus further comprises a basket unit configured to receive a sheet discharged from the print unit.

15. The printing apparatus according to claim 7, wherein the printing apparatus further comprises:

a winding unit configured to wind up a continuous sheet thereon in a roll shape;

a second driving unit configured to rotate the winding unit; and a second pressing member configured to press a surface of the continuous sheet wound on the winding unit, wherein the control unit further controls a pressing force of the second pressing member.

16. The printing apparatus according to claim 15, wherein the control unit controls the pressing force of the second pressing member such that when cutting of the continuous sheet is performed by the cutter unit, the second pressing member presses a surface of the continuous sheet.

17. The printing apparatus according to claim 15, wherein the control unit controls a pressing force of the second pressing member in accordance with at least one of a sheet type of the continuous sheet and whether winding up of the continuous sheet fed from the printing unit is performed such that a print surface of the continuous sheet is wound outwardly.

18. The printing apparatus according to claim 15, wherein the winding unit and the mount unit are arranged in a vertical direction with respect to each other below the printing unit.

19. The printing apparatus according to claim 15, wherein the winding unit is further configured to be able to feed out the continuous sheet wound thereon to the printing unit for printing, and the control unit operates in (a) a mode of operation in which the roll sheet is fed from the mount unit to the printing unit for printing and (b) a mode of operation in which the continuous sheet is fed from the winding unit to the printing unit for printing.

20. The printing apparatus according to claim 15, wherein the printing apparatus further comprises a basket unit configured to receive a sheet discharged from the print unit, and the control unit operates in (a) a mode of operation in which a printed sheet discharged from the printing unit is received in the basket unit and (b) a mode of operation in which a printed sheet discharged from the print unit is wound up on the winding unit.

* * * * *